US007398838B2

(12) United States Patent
Harder et al.

(10) Patent No.: US 7,398,838 B2
(45) Date of Patent: Jul. 15, 2008

(54) IMPACT EXCAVATION SYSTEM AND METHOD WITH TWO-STAGE INDUCTOR

(75) Inventors: Nathan J. Harder, Houston, TX (US); Harry B. Curlett, Cody, WY (US); Paul O. Padgett, Casper, WY (US); Samuel R. Curlett, Powell, WY (US)

(73) Assignee: Particle Drilling Technologies, Inc., Houston, TX (US)

( * ) Notice: Subject to any disclaimer, the term of this patent is extended or adjusted under 35 U.S.C. 154(b) by 151 days.

(21) Appl. No.: 11/204,981

(22) Filed: Aug. 16, 2005
(Under 37 CFR 1.47)

(65) Prior Publication Data

US 2006/0191717 A1 Aug. 31, 2006

Related U.S. Application Data

(63) Continuation-in-part of application No. 10/897,196, filed on Jul. 22, 2004, which is a continuation-in-part of application No. 10/825,338, filed on Apr. 15, 2004, now Pat. No. 7,258,176.

(60) Provisional application No. 60/463,903, filed on Apr. 16, 2003.

(51) Int. Cl.
*E21B 7/16* (2006.01)

(52) U.S. Cl. ..... 175/54; 175/65; 175/206; 166/75.15

(58) Field of Classification Search ..... 175/54, 175/65, 206; 166/75.15
See application file for complete search history.

(56) References Cited

U.S. PATENT DOCUMENTS 2,626,779 A * 1/1953 Armentrout ..... 166/278
2,724,574 A * 11/1955 Ledgerwood, Jr. ..... 175/27
2,779,571 A * 1/1957 Ortloff ..... 175/54
2,807,442 A * 9/1957 Ledgerwood, Jr. ..... 175/54

(Continued)

FOREIGN PATENT DOCUMENTS

GB 2385346 A 8/2003

(Continued)

OTHER PUBLICATIONS

*Curlett Family Limited Partnership, Ltd., Plaintiff V. Particle Drilling Technlogies, Inc., a Delaware Corporation; and Particle Drilling Technologies, Inc., a Nevada Corporatio Defendant*; Civil Action No. 4:06-CV-01012; Affidavit of Harry (Hal) B. Curlett, May 3, 2006.

(Continued)

*Primary Examiner*—David J. Bagnell
*Assistant Examiner*—Nicole Coy
(74) *Attorney, Agent, or Firm*—Bracewell & Giuliani LLP

(57) ABSTRACT

A system and method for excavating a subterranean formation according to which a fluid is introduced into a vessel to draw a plurality of impactors into the vessel to form a suspension. The suspension is discharged from the vessel and into another vessel, and fluid is introduced into the other vessel to draw the suspension into the other vessel. A suspension is formed in the other vessel that is discharged towards the formation to remove a portion of the formation.

12 Claims, 12 Drawing Sheets

U.S. PATENT DOCUMENTS

| | | | | | |
|---|---|---|---|---|---|
| 2,809,013 | A | * | 10/1957 | Ledgerwood, Jr. et al. | 175/317 |
| 2,815,931 | A | * | 12/1957 | Williams | 175/54 |
| 2,841,365 | A | * | 7/1958 | Ramsey et al. | 175/54 |
| 2,868,509 | A | * | 1/1959 | Williams | 175/54 |
| 3,112,800 | A | | 12/1963 | Bobo | |
| 3,322,214 | A | * | 5/1967 | Buck | 175/66 |
| 3,416,614 | A | | 12/1968 | Goodwin et al. | |
| 3,576,221 | A | | 4/1971 | Hasiba | |
| 3,704,966 | A | | 12/1972 | Beck, Jr. | |
| 3,852,200 | A | | 12/1974 | Meyer | |
| 3,865,202 | A | | 2/1975 | Takahashi et al. | |
| 3,924,698 | A | | 12/1975 | Juvkam-Wold | |
| 4,042,048 | A | | 8/1977 | Schwabe | |
| 4,067,617 | A | * | 1/1978 | Bunnelle | 299/17 |
| 4,141,592 | A | | 2/1979 | Lavon | |
| 4,391,339 | A | | 7/1983 | Johnson, Jr. et al. | |
| 4,534,427 | A | | 8/1985 | Wang et al. | |
| 4,624,327 | A | | 11/1986 | Reichman | |
| 4,768,709 | A | | 9/1988 | Yie | |
| 4,825,963 | A | | 5/1989 | Ruhle | |
| 5,199,512 | A | | 4/1993 | Curlett | |
| 5,291,957 | A | | 3/1994 | Curlett | |
| 5,355,967 | A | | 10/1994 | Mueller et al. | |
| 5,542,486 | A | | 8/1996 | Curlett | |
| 5,862,871 | A | | 1/1999 | Curlett | |
| 5,944,123 | A | | 8/1999 | Johnson | |
| 6,142,248 | A | | 11/2000 | Thigpen et al. | |
| 6,347,675 | B1 | | 2/2002 | Kolle | |
| 6,386,300 | B1 | | 5/2002 | Curlett et al. | |
| 6,571,700 | B2 | | 6/2003 | Nakamura et al. | |
| 6,581,700 | B2 | | 6/2003 | Curlett et al. | |
| 2002/0011338 | A1 | * | 1/2002 | Maurer et al. | 166/372 |
| 2006/0011386 | A1 | | 1/2006 | Tibbitts | |
| 2006/0016622 | A1 | | 1/2006 | Tibbitts | |
| 2006/0016624 | A1 | | 1/2006 | Tibbitts | |
| 2006/0021798 | A1 | | 2/2006 | Tibbitts | |
| 2006/0027398 | A1 | | 2/2006 | Tibbitts et al. | |

FOREIGN PATENT DOCUMENTS

| | | | |
|---|---|---|---|
| GB | 2385346 | B | 9/2004 |
| WO | WO 02/25053 | A1 | 3/2002 |
| WO | WO 2004/094734 | A2 | 11/2004 |
| WO | WO 2004/106693 | | 12/2004 |

OTHER PUBLICATIONS

Geddes et al., "Leveraging a New Energy Source to Enhance Heavy-Oil and Oil-Sands Production," Society of Petroleum Engineers, SPE/PS-CIM/CHOA 97781, 2005.
www.particledrilling.com, May 4, 2006.
Anderson, Arthur, "Global E&P Trends," Jul. 1999.
Cohen et al., "High-Pressure Jet Kerf Drilling Shows Significant Potential to Increase ROP," SPE 96557, Oct. 2005, 1-8.
Deep Drilling Basic Research Final Report, Jun. 1990.
Eckel et al., "Development and Testing of Jet Pump Pellet Impact Drill Bits," Petroleum Transactions, Aime, 1956, 1-10, vol. 207.
Fair, John, "Development of High-Pressure Abrasive-Jet Drilling," Journal of Petroleum Technology, Aug. 1981, 1379-1388.
Galecki et al., "Steel Shot Entrained Ultra High Pressure Waterjet For Cutting and Drilling in Hard Rocks," 371-388.
Killalea, Mike, "High Pressure Drilling System Triples ROPS, Stymies Bit Wear," Drilling, Mar./Apr. 1989, 10-12.
Kolle et al., "Laboratory and Field Testing of an Ultra-High-Pressure, Jet-Assisted Drilling System," SPE/IADC 22000, 1991, 847-856.
Ledgerwood, L., "Efforts to Devlop Improved Oilwell Drilling Methods," Petroleum Transactions, Aime, 1960, 61-74, vol. 219.
Maurer, William, "Advanced Drilling Techniques," Chapter 5, 19-27, Petroleum Publishing Co., Tulsa, OK.
Maurer, William, "Impact Crater Formation in Rock," Journal of Applied Physics, Jul. 1960, 1247-1252, vol. 31, No. 7.
Peterson et al., "A New Look at Bit-Flushing,".
Ripkin et al., "A Study of the Fragmentation of Rock by Impingement with Water and Solid Impactors," University of Minnesota St. Anthony Falls Hydraulic Laboratory, Feb. 1972.
Review of Mechanical Bit/Rock Interactions, vol. 3, 3-1-3-68.
Security DBS, 1995.
Singh, Madan, "Rock Breakage By Pellet Impact," IIT Research Institute, Dec. 24, 1969.
Summers et al., "A Further Investigation of DIAjet Cutting," Jet Cutting Technology-Proceedings of the 10th International Conference, 1991, pp. 181-192; Elsevier Science Publishers Ltd, USA.
Summers, David, "Waterjetting Technology," Abrasive Waterjet Drilling, 557-598.
Veenhuizen, et al., "Ultra-High Pressure Jet Assist of Mechanical Drilling," SPE/IADC 37579, 79-90, 1997.
Co-pending U.S. Appl. No. 10/558,181 filed Nov. 22, 2005, Titled "System for Cutting Earthen Formations".
Co-pending U.S. Appl. No. 10/825,338 filed Apr. 15, 2004, Titled "Drill Bit".
Co-pending U.S. Appl. No. 10/897,196 filed Jul. 22, 2004, Titled "Impact Excavation System and Method".
Co-pending U.S. Appl. No. 11/204,436 filed Aug. 16, 2005, Titled "Internal Subs with Flow Control of Shot".
Co-pending U.S. Appl. No. 11/204,442 filed Aug. 16, 2005, Titled "Impact Excavation System and Method with Particle Trap".
Co-pending U.S. Appl. No. 11/204,722 filed Aug. 16, 2005, Titled "Shot Trap".
Co-pending U.S. Appl. No. 11/204,862 filed Aug. 16, 2005, Titled "PID Nozzles".
Co-pending U.S. Appl. No. 11/205,006 filed Aug. 16, 2005, Titled "Secondary Types of Educators".
International Search Report PCT/US04/11578; Dated Dec. 28, 2004.
International Preliminary Report of Patentability PCT/US04/11578; Dated Oct. 21, 2005.
Written Opinion PCT/US04/11578; Dated Dec. 28, 2004.

* cited by examiner

IMPACT EXCAVATION SYSTEM AND METHOD WITH TWO-STAGE INDUCTOR

CROSS-REFERENCE TO RELATED APPLICATIONS

This application is a continuation-in-part of pending application Ser. No. 10/897,196, filed Jul. 22, 2004 which, in turn, is a continuation-in-part of pending application Ser. No. 10/825,338, filed Apr. 15, 2004, which, in turn, claims the benefit of 35 U.S.C. 111(b) provisional application Ser. No. 60/463,903, filed Apr. 16, 2003, the disclosures of which are incorporated herein by reference.

BACKGROUND

This disclosure relates to a system and method for excavating a formation, such as to form a well bore for the purpose of oil and gas recovery, to construct a tunnel, or to form other excavations in which the formation is cut, milled, pulverized, scraped, sheared, indented, and/or fractured, (hereinafter referred to collectively as "cutting"). The cutting process is a very interdependent process that preferably integrates and considers many variables to ensure that a usable bore is constructed. As is commonly known in the art, many variables have an interactive and cumulative effect of increasing cutting costs. These variables may include formation hardness, abrasiveness, pore pressures, and formation elastic properties. In drilling wellbores, formation hardness and a corresponding degree of drilling difficulty may increase exponentially as a function of increasing depth. A high percentage of the costs to drill a well are derived from interdependent operations that are time sensitive, i.e., the longer it takes to penetrate the formation being drilled, the more it costs. One of the most important factors affecting the cost of drilling a wellbore is the rate at which the formation can be penetrated by the drill bit, which typically decreases with harder and tougher formation materials and formation depth.

There are generally two categories of modern drill bits that have evolved from over a hundred years of development and untold amounts of dollars spent on the research, testing and iterative development. These are the commonly known as the fixed cutter drill bit and the roller cone drill bit. Within these two primary categories, there are a wide variety of variations, with each variation designed to drill a formation having a general range of formation properties. These two categories of drill bits generally constitute the bulk of the drill bits employed to drill oil and gas wells around the world.

Each type of drill bit is commonly used where its drilling economics are superior to the other. Roller cone drill bits can drill the entire hardness spectrum of rock formations. Thus, roller cone drill bits are generally run when encountering harder rocks where long bit life and reasonable penetration rates are important factors on the drilling economics. Fixed cutter drill bits, on the other hand, are used to drill a wide variety of formations ranging from unconsolidated and weak rocks to medium hard rocks.

In the case of creating a borehole with a roller cone type drill bit, several actions effecting rate of penetration (ROP) and bit efficiency may be occurring. The roller cone bit teeth may be cutting, milling, pulverizing, scraping, shearing, sliding over, indenting, and fracturing the formation the bit is encountering. The desired result is that formation cuttings or chips are generated and circulated to the surface by the drilling fluid. Other factors may also affect ROP, including formation structural or rock properties, pore pressure, temperature, and drilling fluid density. When a typical roller cone rock bit tooth presses upon a very hard, dense, deep formation, the tooth point may only penetrate into the rock a very small distance, while also at least partially, plastically "working" the rock surface.

One attempt to increase the effective rate of penetration (ROP) involved high-pressure circulation of a drilling fluid as a foundation for potentially increasing ROP. It is common knowledge that hydraulic power available at the rig site vastly outweighs the power available to be employed mechanically at the drill bit. For example, modem drilling rigs capable of drilling a deep well typically have in excess of 3000 hydraulic horsepower available and can have in excess of 6000 hydraulic horsepower available while less than one-tenth of that hydraulic horsepower may be available at the drill bit. Mechanically, there may be less than 100 horsepower available at the bit/rock interface with which to mechanically drill the formation.

An additional attempt to increase ROP involved incorporating entrained abrasives in conjunction with high pressure drilling fluid ("mud"). This resulted in an abrasive laden, high velocity jet assisted drilling process. Work done by Gulf Research and Development disclosed the use of abrasive laden jet streams to cut concentric grooves in the bottom of the hole leaving concentric ridges that are then broken by the mechanical contact of the drill bit. Use of entrained abrasives in conjunction with high drilling fluid pressures caused accelerated erosion of surface equipment and an inability to control drilling mud density, among other issues. Generally, the use of entrained abrasives was considered practically and economically unfeasible. This work was summarized in the last published article titled "Development of High Pressure Abrasive-Jet Drilling," authored by John C. Fair, Gulf Research and Development. It was published in the Journal of Petroleum Technology in the May 1981 issue, pages 1379 to 1388.

Another effort to utilize the hydraulic horsepower available at the bit incorporated the use of ultra-high pressure jet assisted drilling. A group known as FlowDril Corporation was formed to develop an ultra-high-pressure liquid jet drilling system in an attempt to increase the rate of penetration. The work was based upon U.S. Pat. No. 4,624,327 and is documented in the published article titled "Laboratory and Field Testing of an Ultra-High Pressure, Jet-Assisted Drilling System" authored by J. J. Kolle, Quest Integrated Inc., and R. Otta and D. L. Stang, FlowDril Corporation; published by SPE/IADC Drilling Conference publications paper number 22000. The cited publication disclosed that the complications of pumping and delivering ultrahigh-pressure fluid from surface pumping equipment to the drill bit proved both operationally and economically unfeasible.

Another effort at increasing rates of penetration by taking advantage of hydraulic horsepower available at the bit is disclosed in U.S. Pat. No. 5,862,871. This development employed the use of a specialized nozzle to excite normally pressured drilling mud at the drill bit. The purpose of this nozzle system was to develop local pressure fluctuations and a high speed, dual jet form of hydraulic jet streams to more effectively scavenge and clean both the drill bit and the formation being drilled. It is believed that these hydraulic jets were able to penetrate the fracture plane generated by the mechanical action of the drill bit in a much more effective manner than conventional jets were able to do. ROP increases from 50% to 400% were field demonstrated and documented in the field reports titled "DualJet Nozzle Field Test Report-Security DBS/Swift Energy Company," and "DualJet Nozzle Equipped M-1LRG Drill Bit Run". The ability of the dual jet ("DualJet") nozzle system to enhance the effectiveness of the drill bit action to increase the ROP required that the drill bits first initiate formation indentations, fractures, or both. These features could then be exploited by the hydraulic action of the DualJet nozzle system.

Due at least partially to the effects of overburden pressure, formations at deeper depths may be inherently tougher to drill due to changes in formation pressures and rock properties, including hardness and abrasiveness. Associated in-situ forces, rock properties, and increased drilling fluid density effects may set up a threshold point at which the drill bit drilling mechanics decrease the drilling efficiency.

Another factor adversely effecting ROP in formation drilling, especially in plastic type rock drilling, such as shale or permeable formations, is a build-up of hydraulically isolated crushed rock material, that can become either mass of reconstituted drill cuttings or a "dynamic filtercake", on the surface being drilled, depending on the formation permeability. In the case of low permeability formations, this occurrence is predominantly a result of repeated impacting and re-compacting of previously drilled particulate material on the bottom of the hole by the bit teeth, thereby forming a false bottom. The substantially continuous process of drilling, re-compacting, removing, re-depositing and re-compacting, and drilling new material may significantly adversely effect drill bit efficiency and ROP. The re-compacted material is at least partially removed by mechanical displacement due to the cone skew of the roller cone type drill bits and partially removed by hydraulics, again emphasizing the importance of good hydraulic action and hydraulic horsepower at the bit. For hard rock bits, build-up removal by cone skew is typically reduced to near zero, which may make build-up removal substantially a function of hydraulics. In permeable formations the continuous deposition and removal of the fine cuttings forms a dynamic filtercake that can reduce the spurt loss and therefore the pore pressure in the working area of the bit. Because the pore pressure is reduced and mechanical load is increased from the pressure drop across the dynamic filtercake, drilling efficiency can be reduced.

There are many variables to consider to ensure a usable well bore is constructed when using cutting systems and processes for the drilling of well bores or the cutting of formations for the construction of tunnels and other subterranean earthen excavations. Many variables, such as formation hardness, abrasiveness, pore pressures, and formation elastic properties affect the effectiveness of a particular drill bit in drilling a well bore. Additionally, in drilling well bores, formation hardness and a corresponding degree of drilling difficulty may increase exponentially as a function of increasing depth. The rate at which a drill bit may penetrate the formation typically decreases with harder and tougher formation materials and formation depth.

When the formation is relatively soft, as with shale, material removed by the drill bit will have a tendency to reconstitute onto the teeth of the drill bit. Build-up of the reconstituted formation on the drill bit is typically referred to as "bit balling" and reduces the depth that the teeth of the drill bit will penetrate the bottom surface of the well bore, thereby reducing the efficiency of the drill bit. Particles of a shale formation also tend to reconstitute back onto the bottom surface of the bore hole. The reconstitution of a formation back onto the bottom surface of the bore hole is typically referred to as "bottom balling". Bottom balling prevents the teeth of a drill bit from engaging virgin formation and spreads the impact of a tooth over a wider area, thereby also reducing the efficiency of a drill bit. Additionally, higher density drilling muds that are required to maintain well bore stability or well bore pressure control exacerbate bit balling and the bottom balling problems.

When the drill bit engages a formation of a harder rock, the teeth of the drill bit press against the formation and densify a small area under the teeth to cause a crack in the formation. When the porosity of the formation is collapsed, or densified, in a hard rock formation below a tooth, conventional drill bit nozzles ejecting drilling fluid are used to remove the crushed material from below the drill bit. As a result, a cushion, or densification pad, of densified material is left on the bottom surface by the prior art drill bits. If the densification pad is left on the bottom surface, force by a tooth of the drill bit will be distributed over a larger area and reduce the effectiveness of a drill bit.

There are generally two main categories of modern drill bits that have evolved over time. These are the commonly known fixed cutter drill bit and the roller cone drill bit. Additional categories of drilling include percussion drilling and mud hammers. However, these methods are not as widely used as the fixed cutter and roller cone drill bits. Within these two primary categories (fixed cutter and roller cone), there are a wide variety of variations, with each variation designed to drill a formation having a general range of formation properties.

The fixed cutter drill bit and the roller cone type drill bit generally constitute the bulk of the drill bits employed to drill oil and gas wells around the world. When a typical roller cone rock bit tooth presses upon a very hard, dense, deep formation, the tooth point may only penetrate into the rock a very small distance, while also at least partially, plastically "working" the rock surface. Under conventional drilling techniques, such working the rock surface may result in the densification as noted above in hard rock formations.

With roller cone type drilling bits, a relationship exists between the number of teeth that impact upon the formation and the drilling RPM of the drill bit. A description of this relationship and an approach to improved drilling technology is set forth and described in U.S. Pat. No. 6,386,300 issued May 14, 2002. The '300 patent discloses the use of solid material impactors introduced into drilling fluid and pumped though a drill string and drill bit to contact the rock formation ahead of the drill bit. The kinetic energy of the impactors leaving the drill bit is given by the following equation: $E_k = \frac{1}{2}\,\text{Mass}(\text{Velocity})^2$. The mass and/or velocity of the impactors may be chosen to satisfy the mass-velocity relationship in order to structurally alter the rock formation.

DETAILED DESCRIPTION

Figure 1:
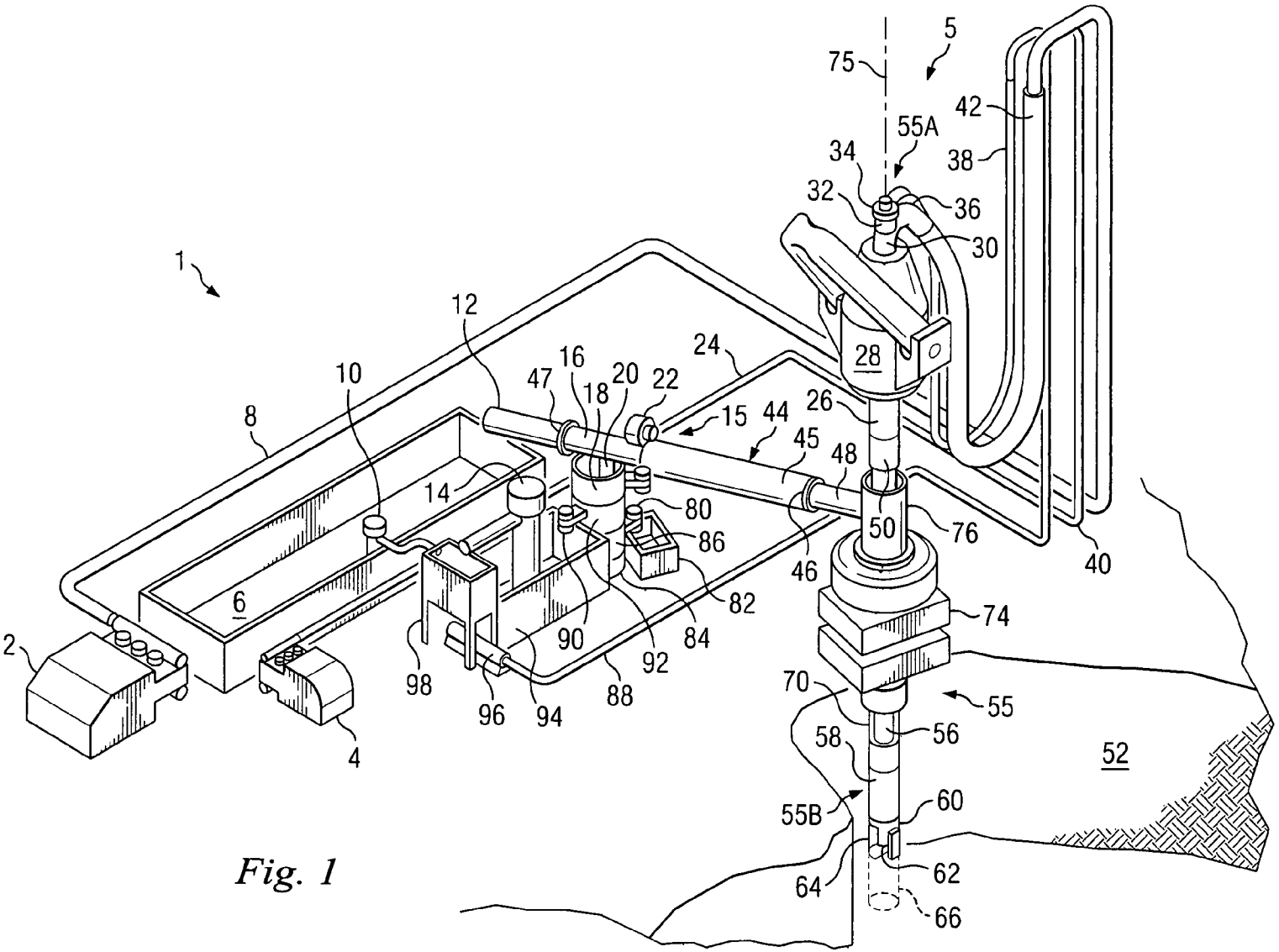
FIG. 1 is an isometric view of an excavation system as used in a preferred embodiment.

In the drawings and description that follows, like parts are marked throughout the specification and drawings with the same reference numerals, respectively. The drawings are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. The various characteristics mentioned above, as well as other features and characteristics described in more detail below, will be readily apparent to those skilled in the art upon reading the following detailed description of the embodiments, and by referring to the accompanying drawings.

Figure 2:
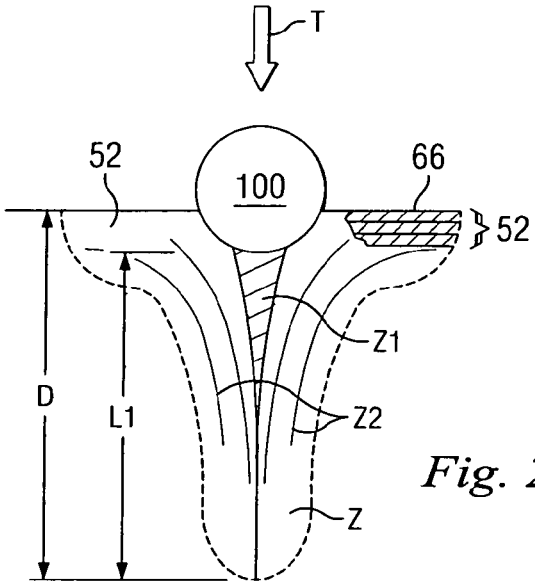
FIG. 2 illustrates an impactor impacted with a formation.

FIGS. 1 and 2 illustrate an embodiment of an excavation system 1 comprising the use of solid material particles, or impactors, 100 to engage and excavate a subterranean formation 52 to create a wellbore 70. The excavation system 1 may comprise a pipe string 55 comprised of collars 58, pipe 56, and a kelly 50. An upper end of the kelly 50 may interconnect with a lower end of a swivel quill 26. An upper end of the swivel quill 26 may be rotatably interconnected with a swivel 28. The swivel 28 may include a top drive assembly (not shown) to rotate the pipe string 55. Alternatively, the excavation system 1 may further comprise a drill bit 60 to cut the formation 52 in cooperation with the solid material impactors 100. The drill bit 60 may be attached to the lower end 55B of the pipe string 55 and may engage a bottom surface 66 of the wellbore 70. The drill bit 60 may be a roller cone bit, a fixed cutter bit, an impact bit, a spade bit, a mill, an impregnated bit, a natural diamond bit, or other suitable implement for cutting rock or earthen formation. Referring to FIG. 1, the pipe string 55 may include a feed, or upper, end 55A located substantially near the excavation rig 5 and a lower end 55B including a nozzle 64 supported thereon. The lower end 55B of the string 55 may include the drill bit 60 supported thereon. The excavation system 1 is not limited to excavating a wellbore 70. The excavation system and method may also be applicable to excavating a tunnel, a pipe chase, a mining operation, or other excavation operation wherein earthen material or formation may be removed.

To excavate the wellbore 70, the swivel 28, the swivel quill 26, the kelly 50, the pipe string 55, and a portion of the drill bit 60, if used, may each include an interior passage that allows circulation fluid to circulate through each of the aforementioned components. The circulation fluid may be withdrawn from a tank 6, pumped by a pump 2, through a through medium pressure capacity line 8, through a medium pressure capacity flexible hose 42, through a gooseneck 36, through the swivel 28, through the swivel quill 26, through the kelly 50, through the pipe string 55, and through the bit 60.

The excavation system 1 further comprises at least one nozzle 64 on the lower 55B of the pipe string 55 for accelerating at least one solid material impactor 100 as they exit the pipe string 100. The nozzle 64 is designed to accommodate the impactors 100, such as an especially hardened nozzle, a shaped nozzle, or an "impactor" nozzle, which may be particularly adapted to a particular application. The nozzle 64 may be a type that is known and commonly available. The nozzle 64 may further be selected to accommodate the impactors 100 in a selected size range or of a selected material composition. Nozzle size, type, material, and quantity may be a function of the formation being cut, fluid properties, impactor properties, and/or desired hydraulic energy expenditure at the nozzle 64. If a drill bit 60 is used, the nozzle or nozzles 64 may be located in the drill bit 60.

The nozzle 64 may alternatively be a conventional dual discharge nozzle. Such dual discharge nozzles may generate: (1) a radially outer circulation fluid jet substantially encircling a jet axis, and/or (2) an axial circulation fluid jet substantially aligned with and coaxial with the jet axis, with the dual discharge nozzle directing a majority by weight of the plurality of solid material impactors into the axial circulation fluid jet. A dual discharge nozzle 64 may separate a first portion of the circulation fluid flowing through the nozzle 64 into a first circulation fluid stream having a first circulation fluid exit nozzle velocity, and a second portion of the circulation fluid flowing through the nozzle 64 into a second circulation fluid stream having a second circulation fluid exit nozzle velocity lower than the first circulation fluid exit nozzle velocity. The plurality of solid material impactors 100 may be directed into the first circulation fluid stream such that a velocity of the plurality of solid material impactors 100 while exiting the nozzle 64 is substantially greater than a velocity of the circulation fluid while passing through a nominal diameter flow path in the lower end 55B of the pipe string 55, to accelerate the solid material impactors 100.

Each of the individual impactors 100 is structurally independent from the other impactors. For brevity, the plurality of solid material impactors 100 may be interchangeably referred to as simply the impactors 100. The plurality of solid material impactors 100 may be substantially rounded and have either a substantially non-uniform outer diameter or a substantially uniform outer diameter. The solid material impactors 100 may be substantially spherically shaped, non-hollow, formed of rigid metallic material, and having high compressive strength and crush resistance, such as steel shot, ceramics, depleted uranium, and multiple component materials. Although the solid material impactors 100 may be substantially a nonhollow sphere, alternative embodiments may provide for other types of solid material impactors, which may include impactors 100 with a hollow interior. The impactors may be substantially rigid and may possess relatively high compressive strength and resistance to crushing or deformation as compared to physical properties or rock properties of a particular formation or group of formations being penetrated by the wellbore 70.

The impactors may be of a substantially uniform mass, grading, or size. The solid material impactors 100 may have any suitable density for use in the excavation system 1. For example, the solid material impactors 100 may have an average density of at least 470 pounds per cubic foot.

Alternatively, the solid material impactors 100 may include other metallic materials, including tungsten carbide, copper, iron, or various combinations or alloys of these and other metallic compounds. The impactors 100 may also be composed of non-metallic materials, such as ceramics, or other man-made or substantially naturally occurring non-metallic materials. Also, the impactors 100 may be crystalline shaped, angular shaped, sub-angular shaped, selectively shaped, such as like a torpedo, dart, rectangular, or otherwise generally non-spherically shaped.

The impactors 100 may be selectively introduced into a fluid circulation system, such as illustrated in FIG. 1, near an excavation rig 5, circulated with the circulation fluid (or "mud"), and accelerated through at least one nozzle 64. "At the excavation rig" or "near an excavation rig" may also include substantially remote separation, such as a separation process that may be at least partially carried out on the sea floor.

Introducing the impactors 100 into the circulation fluid may be accomplished by any of several known techniques. For example, the impactors 100 may be provided in an impactor storage tank 94 near the rig 5 or in a storage bin 82. A screw elevator 14 may then transfer a portion of the impactors at a selected rate from the storage tank 94, into a slurrification tank 98. A pump 10, such as a progressive cavity pump may transfer a selected portion of the circulation fluid from a mud tank 6, into the slurrification tank 98 to be mixed with the impactors 100 in the tank 98 to form an impactor concentrated slurry. An impactor introducer 96 may be included to pump or introduce a plurality of solid material impactors 100 into the circulation fluid before circulating a plurality of impactors 100 and the circulation fluid to the nozzle 64. The impactor introducer 96 may be a progressive cavity pump capable of pumping the impactor concentrated slurry at a selected rate and pressure through a slurry line 88, through a slurry hose 38, through an impactor slurry injector head 34, and through an injector port 30 located on the gooseneck 36, which may be located atop the swivel 28. The swivel 36, including the through bore for conducting circulation fluid therein, may be substantially supported on the feed, or upper, end of the pipe string 55 for conducting circulation fluid from the gooseneck 36 into the latter end 55*a*. The upper end 55A of the pipe string 55 may also include the kelly 50 to connect the pipe 56 with the swivel quill 26 and/or the swivel 28. The circulation fluid may also be provided with rheological properties sufficient to adequately transport and/or suspend the plurality of solid material impactors 100 within the circulation fluid.

The solid material impactors 100 may also be introduced into the circulation fluid by withdrawing the plurality of solid material impactors 100 from a low pressure impactor source 98 into a high velocity stream of circulation fluid, such as by venturi effect. For example, when introducing impactors 100 into the circulation fluid, the rate of circulation fluid pumped by the mud pump 2 may be reduced to a rate lower than the mud pump 2 is capable of efficiently pumping. In such event, a lower volume mud pump 4 may pump the circulation fluid through a medium pressure capacity line 24 and through the medium pressure capacity flexible hose 40.

The circulation fluid may be circulated from the fluid pump 2 and/or 4, such as a positive displacement type fluid pump, through one or more fluid conduits 8, 24, 40, 42, into the pipe string 55. The circulation fluid may then be circulated through the pipe string 55 and through the nozzle 64. The circulation fluid may be pumped at a selected circulation rate and/or a selected pump pressure to achieve a desired impactor and/or fluid energy at the nozzle 64.

The pump 4 may also serve as a supply pump to drive the introduction of the impactors 100 entrained within an impactor slurry, into the high pressure circulation fluid stream pumped by mud pumps 2 and 4. Pump 4 may pump a percentage of the total rate of fluid being pumped by both pumps 2 and 4, such that the circulation fluid pumped by pump 4 may create a venturi effect and/or vortex within the injector head 34 that inducts the impactor slurry being conducted through the line 42, through the injector head 34, and then into the high pressure circulation fluid stream.

From the swivel 28, the slurry of circulation fluid and impactors may circulate through the interior passage in the pipe string 55 and through the nozzle 64. As described above, the nozzle 64 may alternatively be at least partially located in the drill bit 60. Each nozzle 64 may include a reduced inner diameter as compared to an inner diameter of the interior passage in the pipe string 55 immediately above the nozzle 64. Thereby, each nozzle 64 may accelerate the velocity of the slurry as the slurry passes through the nozzle 64. The nozzle 64 may also direct the slurry into engagement with a selected portion of the bottom surface 66 of wellbore 70. The nozzle 64 may also be rotated relative to the formation 52 depending on the excavation parameters. To rotate the nozzle 64, the entire pipe string 55 may be rotated or only the nozzle 64 on the end of the pipe string 55 may be rotated while the pipe string 55 is not rotated. Rotating the nozzle 64 may also include oscillating the nozzle 64 rotationally back and forth as well as vertically, and may further include rotating the nozzle 64 in discrete increments. The nozzle 64 may also be maintained rotationally substantially stationary.

The circulation fluid may be substantially continuously circulated during excavation operations to circulate at least some of the plurality of solid material impactors 100 and the formation cuttings away from the nozzle 64. The impactors 100 and fluid circulated away from the nozzle 64 may be circulated substantially back to the excavation rig 5, or circulated to a substantially intermediate position between the excavation rig 5 and the nozzle 64.

If a drill bit 60 is used, the drill bit 60 may be rotated relative to the formation 52 and engaged therewith by an axial force (WOB) acting at least partially along the wellbore axis 75 near the drill bit 60. The bit 60 may also comprise a plurality of bit cones 62, which also may rotate relative to the bit 60 to cause bit teeth secured to a respective cone to engage the formation 52, which may generate formation cuttings substantially by crushing, cutting, or pulverizing a portion of the formation 52. The bit 60 may also be comprised of a fixed cutting structure that may be substantially continuously engaged with the formation 52 and create cuttings primarily by shearing and/or axial force concentration to fail the formation, or create cuttings from the formation 52. To rotate the bit 60, the entire pipe string 55 may be rotated or only the bit 60 on the end of the pipe string 55 may be rotated while the pipe string 55 is not rotated. Rotating the drill bit 60 may also include oscillating the drill bit 60 rotationally back and forth as well as vertically, and may further include rotating the drill bit 60 in discrete increments.

Also alternatively, the excavation system 1 may comprise a pump, such as a centrifugal pump, having a resilient lining that is compatible for pumping a solid-material laden slurry. The pump may pressurize the slurry to a pressure greater than the selected mud pump pressure to pump the plurality of solid material impactors 100 into the circulation fluid. The impactors 100 may be introduced through an impactor injection port, such as port 30. Other alternative embodiments for the system 1 may include an impactor injector for introducing the plurality of solid material impactors 100 into the circulation fluid.

As the slurry is pumped through the pipe string 55 and out the nozzles 64, the impactors 100 may engage the formation with sufficient energy to enhance the rate of formation removal or penetration (ROP). The removed portions of the formation may be circulated from within the wellbore 70 near the nozzle 64, and carried suspended in the fluid with at least a portion of the impactors 100, through a wellbore annulus between the OD of the pipe string 55 and the ID of the wellbore 70.

At the excavation rig 5, the returning slurry of circulation fluid, formation fluids (if any), cuttings, and impactors 100 may be diverted at a nipple 76, which may be positioned on a BOP stack 74. The returning slurry may flow from the nipple 76, into a return flow line 15, which maybe comprised of tubes 48, 45, 16, 12 and flanges 46, 47. The return line 15 may include an impactor reclamation tube assembly 44, as illustrated in FIG. 1, which may preliminarily separate a majority of the returning impactors 100 from the remaining components of the returning slurry to salvage the circulation fluid for recirculation into the present wellbore 70 or another wellbore. At least a portion of the impactors 100 may be separated from a portion of the cuttings by a series of screening devices, such as the vibrating classifiers 84, to salvage a reusable portion of the impactors 100 for reuse to re-engage the formation 52. A majority of the cuttings and a majority of non-reusable impactors 100 may also be discarded.

The reclamation tube assembly 44 may operate by rotating tube 45 relative to tube 16. An electric motor assembly 22 may rotate tube 44. The reclamation tube assembly 44 comprises an enlarged tubular 45 section to reduce the return flow slurry velocity and allow the slurry to drop below a terminal velocity of the impactors 100, such that the impactors 100 can no longer be suspended in the circulation fluid and may gravitate to a bottom portion of the tube 45. This separation function may be enhanced by placement of magnets near and along a lower side of the tube 45. The impactors 100 and some of the larger or heavier cuttings may be discharged through discharge port 20. The separated and discharged impactors 100 and solids discharged through discharge port 20 may be gravitationally diverted into a vibrating classifier 84 or may be pumped into the classifier 84. A pump (not shown) capable of handling impactors and solids, such as a progressive cavity pump may be situated in communication with the flow line discharge port 20 to conduct the separated impactors 100 selectively into the vibrating separator 84 or elsewhere in the circulation fluid circulation system.

The vibrating classifier 84 may comprise a three-screen section classifier of which screen section 18 may remove the coarsest grade material. The removed coarsest grade material may be selectively directed by outlet 78 to one of storage bin 82 or pumped back into the flow line 15 downstream of discharge port 20. A second screen section 92 may remove a re-usable grade of impactors 100, which in turn may be directed by outlet 90 to the impactor storage tank 94. A third screen section 86 may remove the finest grade material from the circulation fluid. The removed finest grade material may be selectively directed by outlet 80 to storage bin 82, or pumped back into the flow line 15 at a point downstream of discharge port 20. Circulation fluid collected in a lower portion of the classified 84 may be returned to a mud tank 6 for re-use.

The circulation fluid may be recovered for recirculation in a wellbore or the circulation fluid may be a fluid that is substantially not recovered. The circulation fluid may be a liquid, gas, foam, mist, or other substantially continuous or multiphase fluid. For recovery, the circulation fluid and other components entrained within the circulation fluid may be directed across a shale shaker (not shown) or into a mud tank 6, whereby the circulation fluid may be further processed for re-circulation into a wellbore.

The excavation system 1 creates a mass-velocity relationship in a plurality of the solid material impactors 100, such that an impactor 100 may have sufficient energy to structurally alter the formation 52 in a zone of a point of impact. The mass-velocity relationship may be satisfied as sufficient when a substantial portion by weight of the solid material impactors 100 may by virtue of their mass and velocity at the exit of the nozzle 64, create a structural alteration as claimed or disclosed herein. Impactor velocity to achieve a desired effect upon a given formation may vary as a function of formation compressive strength, hardness, or other rock properties, and as a function of impactor size and circulation fluid rheological properties. A substantial portion means at least five percent by weight of the plurality of solid material impactors that are introduced into the circulation fluid.

The impactors 100 for a given velocity and mass of a substantial portion by weight of the impactors 100 are subject to the following mass-velocity relationship. The resulting kinetic energy of at least one impactor 100 exiting a nozzle 64 is at least 0.075 Ft.Lbs or has a minimum momentum of 0.0003 Lbf.Sec.

Kinetic energy is quantified by the relationship of an object's mass and its velocity. The quantity of kinetic energy associated with an object is calculated by multiplying its mass times its velocity squared. To reach a minimum value of kinetic energy in the mass-velocity relationship as defined, small particles such as those found in abrasives and grits, must have a significantly high velocity due to the small mass of the particle. A large particle, however, needs only moderate velocity to reach an equivalent kinetic energy of the small particle because its mass may be several orders of magnitude larger.

The velocity of a substantial portion by weight of the plurality of solid material impactors 100 immediately exiting a nozzle 64 may be as slow as 100 feet per second and as fast as 1000 feet per second, immediately upon exiting the nozzle 64.

The velocity of a majority by weight of the impactors 100 may be substantially the same, or only slightly reduced, at the point of impact of an impactor 100 at the formation surface 66 as compared to when leaving the nozzle 64. Thus, it may be appreciated by those skilled in the art that due to the close proximity of a nozzle 64 to the formation being impacted, the velocity of a majority of impactors 100 exiting a nozzle 64 may be substantially the same as a velocity of an impactor 100 at a point of impact with the formation 52. Therefore, in many practical applications, the above velocity values may be determined or measured at substantially any point along the path between near an exit end of a nozzle 64 and the point of impact, without material deviation from the scope of this invention.

In addition to the impactors 100 satisfying the mass-velocity relationship described above, a substantial portion by weight of the solid material impactors 100 have an average mean diameter of between approximately 0.050 to 0.500 of an inch.

To excavate a formation 52, the excavation implement, such as a drill bit 60 or impactor 100, must overcome minimum, in-situ stress levels or toughness of the formation 52. These minimum stress levels are known to typically range from a few thousand pounds per square inch, to in excess of 65,000 pounds per square inch. To fracture, cut, or plastically deform a portion of formation 52, force exerted on that portion of the formation 52 typically should exceed the minimum, in-situ stress threshold of the formation 52. When an impactor 100 first initiates contact with a formation, the unit stress exerted upon the initial contact point may be much higher than 10,000 pounds per square inch, and may be well in excess of one million pounds per square inch. The stress applied to the formation 52 during contact is governed by the force the impactor 100 contacts the formation with and the area of contact of the impactor with the formation. The stress is the force divided by the area of contact. The force is governed by Impulse Momentum theory whereby the time at which the contact occurs determines the magnitude of the force applied to the area of contact. In cases where the particle is contacting a relatively hard surface at an elevated velocity, the force of the particle when in contact with the surface is not constant, but is better described as a spike. However, the force need not be limited to any specific amplitude or duration. The magnitude of the spike load can be very large and occur in just a small fraction of the total impact time. If the area of contact is small the unit stress can reach values many times in excess of the in situ failure stress of the rock, thus guaranteeing fracture initiation and propagation and structurally altering the formation 52.

A substantial portion by weight of the solid material impactors 100 may apply at least 5000 pounds per square inch of unit stress to a formation 52 to create the structurally altered zone Z in the formation. The structurally altered zone Z is not limited to any specific shape or size, including depth or width. Further, a substantial portion by weight of the impactors 100 may apply in excess of 20,000 pounds per square inch of unit stress to the formation 52 to create the structurally altered zone Z in the formation. The mass-velocity relationship of a substantial portion by weight of the plurality of solid material impactors 100 may also provide at least 30,000 pounds per square inch of unit stress.

A substantial portion by weight of the solid material impactors 100 may have any appropriate velocity to satisfy the mass-velocity relationship. For example, a substantial portion by weight of the solid material impactors may have a velocity of at least 100 feet per second when exiting the nozzle 64. A substantial portion by weight of the solid material impactors 100 may also have a velocity of at least 100 feet per second and as great as 1200 feet per second when exiting the nozzle 64. A substantial portion by weight of the solid material impactors 100 may also have a velocity of at least 100 feet per second and as great as 750 feet per second when exiting the nozzle 64. A substantial portion by weight of the solid material impactors 100 may also have a velocity of at least 350 feet per second and as great as 500 feet per second when exiting the nozzle 64.

Impactors 100 may be selected based upon physical factors such as size, projected velocity, impactor strength, formation 52 properties and desired impactor concentration in the circulation fluid. Such factors may also include; (a) an expenditure of a selected range of hydraulic horsepower across the one or more nozzles, (b) a selected range of circulation fluid velocities exiting the one or more nozzles or impacting the formation, and (c) a selected range of solid material impactor velocities exiting the one or more nozzles or impacting the formation, (d) one or more rock properties of the formation being excavated, or (e), any combination thereof.

If an impactor 100 is of a specific shape such as that of a dart, a tapered conic, a rhombic, an octahedral, or similar oblong shape, a reduced impact area to impactor mass ratio may be achieved. The shape of a substantial portion by weight of the impactors 100 may be altered, so long as the mass-velocity relationship remains sufficient to create a claimed structural alteration in the formation and an impactor 100 does not have any one length or diameter dimension greater than approximately 0.100 inches. Thereby, a velocity required to achieve a specific structural alteration may be reduced as compared to achieving a similar structural alteration by impactor shapes having a higher impact area to mass ratio. Shaped impactors 100 may be formed to substantially align themselves along a flow path, which may reduce variations in the angle of incidence between the impactor 100 and the formation 52. Such impactor shapes may also reduce impactor contact with the flow structures such those in the pipe string 55 and the excavation rig 5 and may thereby minimize abrasive erosion of flow conduits.

Referring to FIGS. 1-4, a substantial portion by weight of the impactors 100 may engage the formation 52 with sufficient energy to enhance creation of a wellbore 70 through the formation 52 by any or a combination of different impact mechanisms. First, an impactor 100 may directly remove a larger portion of the formation 52 than may be removed by abrasive-type particles. In another mechanism, an impactor 100 may penetrate into the formation 52 without removing formation material from the formation 52. A plurality of such formation penetrations, such as near and along an outer perimeter of the wellbore 70 may relieve a portion of the stresses on a portion of formation being excavated, which may thereby enhance the excavation action of other impactors 100 or the drill bit 60. Third, an impactor 100 may alter one or more physical properties of the formation 52. Such physical alterations may include creation of micro-fractures and increased brittleness in a portion of the formation 52, which may thereby enhance effectiveness the impactors 100 in excavating the formation 52. The constant scouring of the bottom of the borehole also prevents the build up of dynamic filter-cake, which can significantly increase the apparent toughness of the formation 52.

FIG. 2 illustrates an impactor 100 that has been impaled into a formation 52, such as a lower surface 66 in a wellbore 70. For illustration purposes, the surface 66 is illustrated as substantially planar and transverse to the direction of impactor travel 100*a*. The impactors 100 circulated through a nozzle 64 may engage the formation 52 with sufficient energy to effect one or more properties of the formation 52.

A portion of the formation 52 ahead of the impactor 100 substantially in the direction of impactor travel T may be altered such as by micro-fracturing and/or thermal alteration due to the impact energy. In such occurrence, the structurally altered zone Z may include an altered zone depth D. An example of a structurally altered zone Z is a compressive zone Z1, which may be a zone in the formation 52 compressed by the impactor 100. The compressive zone Z1 may have a length L1, but is not limited to any specific shape or size. The compressive zone Z1 may be thermally altered due to impact energy.

An additional example of a structurally altered zone 102 near a point of impaction may be a zone of micro-fractures Z2. The structurally altered zone Z may be broken or otherwise altered due to the impactor 100 and/or a drill bit 60, such as by crushing, fracturing, or micro-fracturing.

FIG. 2 also illustrates an impactor 100 implanted into a formation 52 and having created an excavation E wherein material has been ejected from or crushed beneath the impactor 100. Thereby the excavation E may be created, which as illustrated in FIG. 3 may generally conform to the shape of the impactor 100.

Figure 3:
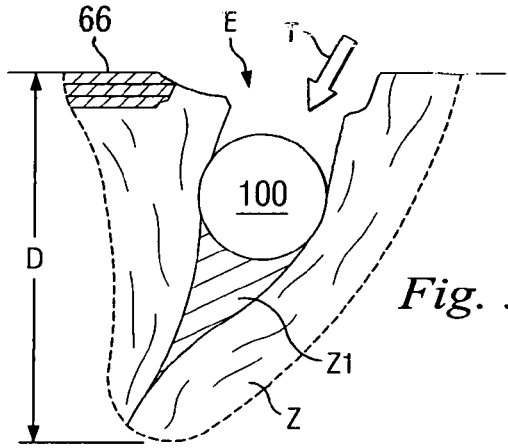
FIG. 3 illustrates an impactor embedded into the formation at an angle to a normalized surface plane of the target formation.
Figure 4:
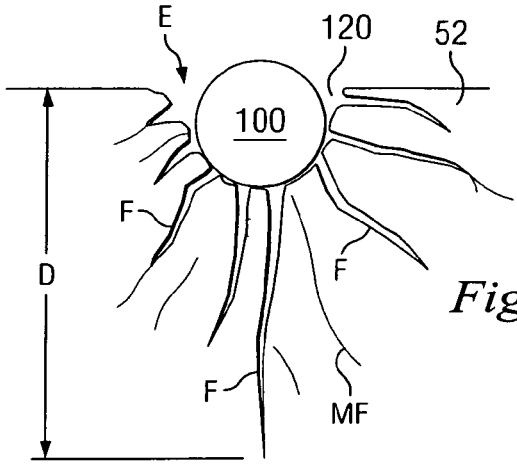
FIG. 4 illustrates an impactor impacting a formation with a plurality of fractures induced by the impact.

FIGS. 3 and 4 illustrate excavations E where the size of the excavation may be larger than the size of the impactor 100. In FIG. 2, the impactor 100 is shown as impacted into the formation 52 yielding an excavation depth D.

An additional theory for impaction mechanics in cutting a formation 52 may postulate that certain formations 52 may be highly fractured or broken up by impactor energy. FIG. 4 illustrates an interaction between an impactor 100 and a formation 52. A plurality of fractures F and micro-fractures MF may be created in the formation 52 by impact energy.

An impactor 100 may penetrate a small distance into the formation 52 and cause the displaced or structurally altered formation 52 to "splay out" or be reduced to small enough particles for the particles to be removed or washed away by hydraulic action. Hydraulic particle removal may depend at least partially upon available hydraulic horsepower and at least partially upon particle wet-ability and viscosity. Such formation deformation may be a basis for fatigue failure of a portion of the formation by "impactor contact," as the plurality of solid material impactors 100 may displace formation material back and forth.

Each nozzle 64 may be selected to provide a desired circulation fluid circulation rate, hydraulic horsepower substantially at the nozzle 64, and/or impactor energy or velocity when exiting the nozzle 64. Each nozzle 64 may be selected as a function of at least one of (a) an expenditure of a selected range of hydraulic horsepower across the one or more nozzles 64, (b) a selected range of circulation fluid velocities exiting the one or more nozzles 64, and (c) a selected range of solid material impactor 100 velocities exiting the one or more nozzles 64.

To optimize ROP, it may be desirable to determine, such as by monitoring, observing, calculating, knowing, or assuming one or more excavation parameters such that adjustments may be made in one or more controllable variables as a function of the determined or monitored excavation parameter. The one or more excavation parameters may be selected from a group comprising: (a) a rate of penetration into the formation 52, (b) a depth of penetration into the formation 52, (c) a formation excavation factor, and (d) the number of solid material impactors 100 introduced into the circulation fluid per unit of time. Monitoring or observing may include monitoring or observing one or more excavation parameters of a group of excavation parameters comprising: (a) rate of nozzle rotation, (b) rate of penetration into the formation 52, (c) depth of penetration into the formation 52, (d) formation excavation factor, (e) axial force applied to the drill bit 60, (f) rotational force applied to the bit 60, (g) the selected circulation rate, (h) the selected pump pressure, and/or (i) wellbore fluid dynamics, including pore pressure.

One or more controllable variables or parameters may be altered, including at least one of (a) rate of impactor 100 introduction into the circulation fluid, (b) impactor 100 size, (c) impactor 100 velocity, (d) drill bit nozzle 64 selection, (e) the selected circulation rate of the circulation fluid, (f) the selected pump pressure, and (g) any of the monitored excavation parameters.

To alter the rate of impactors 100 engaging the formation 52, the rate of impactor 100 introduction into the circulation fluid may be altered. The circulation fluid circulation rate may also be altered independent from the rate of impactor 100 introduction. Thereby, the concentration of impactors 100 in the circulation fluid may be adjusted separate from the fluid circulation rate. Introducing a plurality of solid material impactors 100 into the circulation fluid may be a function of impactor 100 size, circulation fluid rate, nozzle rotational speed, wellbore 70 size, and a selected impactor 100 engagement rate with the formation 52. The impactors 100 may also be introduced into the circulation fluid intermittently during the excavation operation. The rate of impactor 100 introduction relative to the rate of circulation fluid circulation may also be adjusted or interrupted as desired.

The plurality of solid material impactors 100 may be introduced into the circulation fluid at a selected introduction rate and/or concentration to circulate the plurality of solid material impactors 100 with the circulation fluid through the nozzle 64. The selected circulation rate and/or pump pressure, and nozzle selection may be sufficient to expend a desired portion of energy or hydraulic horsepower in each of the circulation fluid and the impactors 100.

An example of an operative excavation system 1 may comprise a bit 60 with an 8½ inch bit diameter. The solid material impactors 100 may be introduced into the circulation fluid at a rate of 12 gallons per minute. The circulation fluid containing the solid material impactors may be circulated through the bit 60 at a rate of 462 gallons per minute. A substantial portion by weight of the solid material impactors may have an average mean diameter of 0.100". The following parameters will result in approximately a 27 feet per hour penetration rate into Sierra White Granite. In this example, the excavation system may produce 1413 solid material impactors 100 per cubic inch with approximately 3.9 million impacts per minute against the formation 52. On average, 0.00007822 cubic inches of the formation 52 are removed per impactor 100 impact. The resulting exit velocity of a substantial portion of the impactors 100 from each of the nozzles 64 would average 495.5 feet per second. The kinetic energy of a substantial portion by weight of the solid material impacts 100 would be approximately 1.14 Ft Lbs., thus satisfying the mass-velocity relationship described above.

Another example of an operative excavation system 1 may comprise a bit 60 with an 8½" bit diameter. The solid material impactors 100 may be introduced into the circulation fluid at a rate of 12 gallons per minute. The circulation fluid containing the solid material impactors may be circulated through the nozzle 64 at a rate of 462 gallons per minute. A substantial portion by weight of the solid material impactors may have an average mean diameter of 0.075". The following parameters will result in approximately a 35 feet per hour penetration rate into Sierra White Granite. In this example, the excavation system 1 may produce 3350 solid material impactors 100 per cubic inch with approximately 9.3 million impacts per minute against the formation 52. On average, 0.0000428 cubic inches of the formation 52 are removed per impactor 100 impact. The resulting exit velocity of a substantial portion of the impactors 100 from each of the nozzles 64 would average 495.5 feet per second. The kinetic energy of a substantial portion by weight of the solid material impacts 100 would be approximately 0.240 Ft Lbs., thus satisfying the mass-velocity relationship described above.

In addition to impacting the formation with the impactors 100, the bit 60 may be rotated while circulating the circulation fluid and engaging the plurality of solid material impactors 100 substantially continuously or selectively intermittently. The nozzle 64 may also be oriented to cause the solid material impactors 100 to engage the formation 52 with a radially outer portion of the bottom hole surface 66. Thereby, as the drill bit 60 is rotated, the impactors 100, in the bottom hole surface 66 ahead of the bit 60, may create one or more circumferential kerfs. The drill bit 60 may thereby generate formation cuttings more efficiently due to reduced stress in the surface 66 being excavated, due to the one or more substantially circumferential kerfs in the surface 66.

The excavation system 1 may also include inputting pulses of energy in the fluid system sufficient to impart a portion of the input energy in an impactor 100. The impactor 100 may thereby engage the formation 52 with sufficient energy to achieve a structurally altered zone Z. Pulsing of the pressure of the circulation fluid in the pipe string 55, near the nozzle 64 also may enhance the ability of the circulation fluid to generate cuttings subsequent to impactor 100 engagement with the formation 52.

Each combination of formation type, bore hole size, bore hole depth, available weight on bit, bit rotational speed, pump rate, hydrostatic balance, circulation fluid rheology, bit type, and tooth/cutter dimensions may create many combinations of optimum impactor presence or concentration, and impactor energy requirements. The methods and systems of this invention facilitate adjusting impactor size, mass, introduction rate, circulation fluid rate and/or pump pressure, and other adjustable or controllable variables to determine and maintain an optimum combination of variables. The methods and systems of this invention also may be coupled with select bit nozzles, downhole tools, and fluid circulating and processing equipment to effect many variations in which to optimize rate of penetration.

Figure 5:
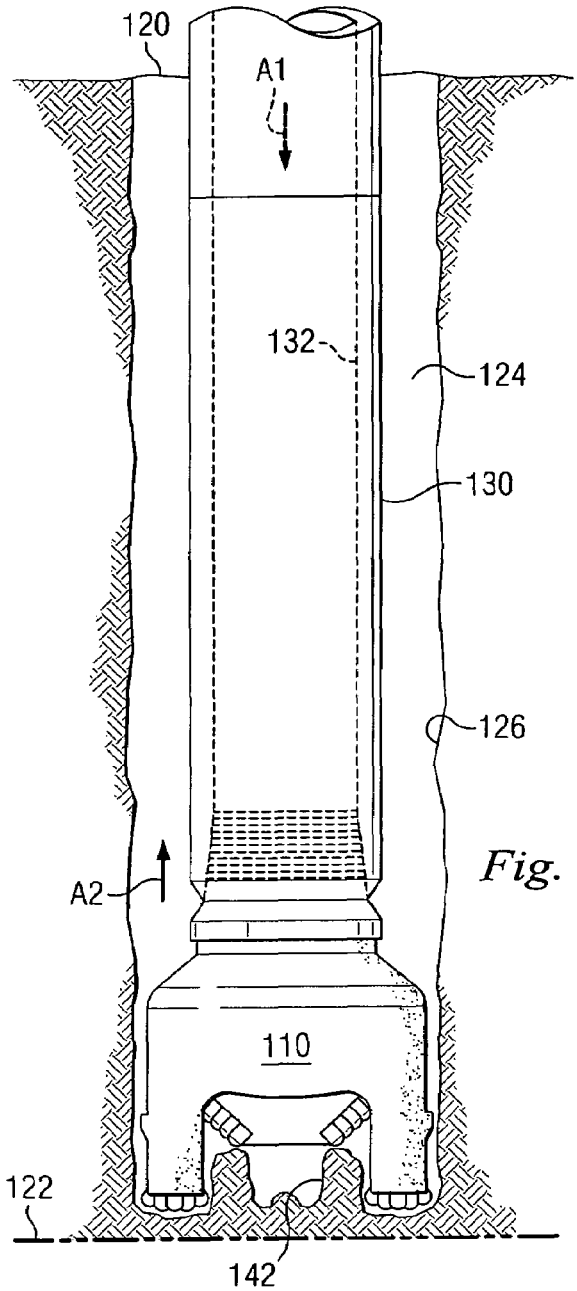
FIG. 5 is a side elevational view of a drilling system utilizing a first embodiment of a drill bit.

FIG. 5 shows an alternate embodiment of the drill bit 60 (FIG. 1) and is referred to, in general, by the reference numeral 110 and which is located at the bottom of a well bore 120 and attached to a drill string 130. The drill bit 110 acts upon a bottom surface 122 of the well bore 120. The drill string 130 has a central passage 132 that supplies drilling fluids to the drill bit 110 as shown by the arrow A1. The drill bit 110 uses the drilling fluids and solid material impactors 100 when acting upon the bottom surface 122 of the well bore 120. The drilling fluids then exit the well bore 120 through a well bore annulus 124 between the drill string 130 and the inner wall 126 of the well bore 120. Particles of the bottom surface 122 removed by the drill bit 110 exit the well bore 120 with the drilling fluid through the well bore annulus 124 as shown by the arrow A2. The drill bit 110 creates a rock ring 142 at the bottom surface 122 of the well bore 120.

Figure 6:
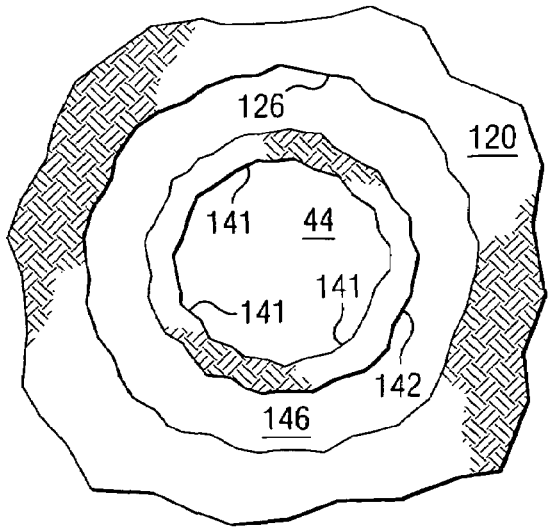
FIG. 6 is a top plan view of the bottom surface of a well bore formed by the drill bit of FIG. 5.

Referring now to FIG. 6, a top view of the rock ring 124 formed by the drill bit 110 is illustrated. An excavated interior cavity 144 is worn away by an interior portion of the drill bit 110 and the exterior cavity 146 and inner wall 126 of the well bore 120 are worn away by an exterior portion of the drill bit 110. The rock ring 142 possesses hoop strength, which holds the rock ring 142 together and resists breakage. The hoop strength of the rock ring 142 is typically much less than the strength of the bottom surface 122 or the inner wall 126 of the well bore 120, thereby making the drilling of the bottom surface 122 less demanding on the drill bit 110. By applying a compressive load and a side load, shown with arrows 141, on the rock ring 142, the drill bit 110 causes the rock ring 142 to fracture. The drilling fluid 140 then washes the residual pieces of the rock ring 142 back up to the surface through the well bore annulus 124.

The mechanical cutters, utilized on many of the surfaces of the drill bit 110, may be any type of protrusion or surface used to abrade the rock formation by contact of the mechanical cutters with the rock formation. The mechanical cutters may be Polycrystalline Diamond Coated (PDC), or any other suitable type mechanical cutter such as tungsten carbide cutters. The mechanical cutters may be formed in a variety of shapes, for example, hemispherically shaped, cone shaped, etc. Several sizes of mechanical cutters are also available, depending on the size of drill bit used and the hardness of the rock formation being cut.

Figure 7:
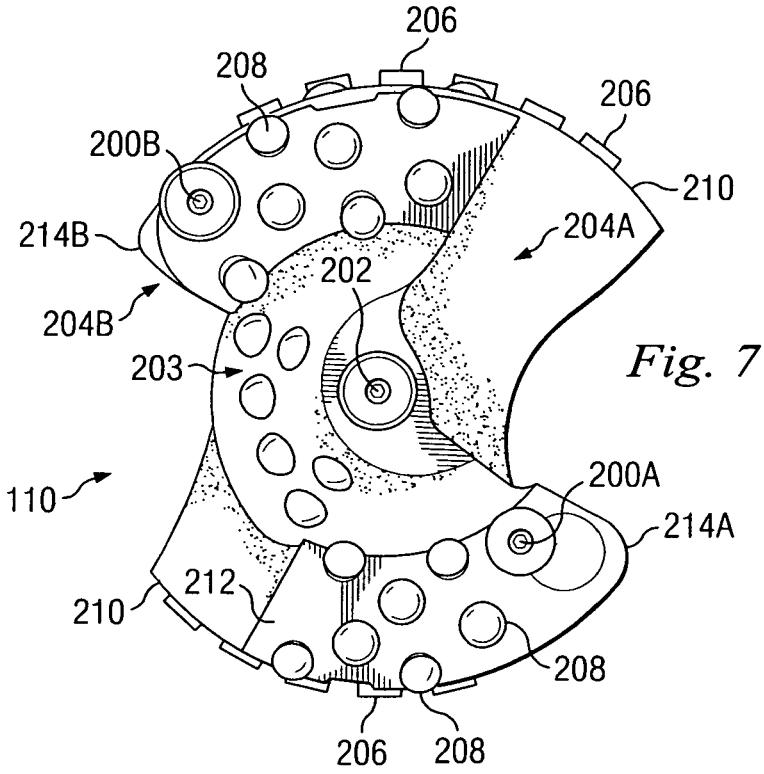
FIG. 7 is an end elevational view of the drill bit of FIG. 5.

Referring now to FIG. 7, an end elevational view of the drill bit 110 of FIG. 5 is illustrated. The drill bit 110 comprises two side nozzles 200A, 200B and a center nozzle 202. The side and center nozzles 200A, 200B, 202 discharge drilling fluid and solid material impactors (not shown) into the rock formation or other surface being excavated. The solid material impactors may comprise steel shot ranging in diameter from about 0.010 to about 0.500 of an inch. However, various diameters and materials such as ceramics, etc. may be utilized in combination with the drill bit 120. The solid material impactors contact the bottom surface 122 of the well bore 120 and are circulated through the annulus 124 to the surface. The solid material impactors may also make up any suitable percentage of the drilling fluid for drilling through a particular formation.

Still referring to FIG. 7 the center nozzle 202 is located in a center portion 203 of the drill bit 110. The center nozzle 202 may be angled to the longitudinal axis of the drill bit 110 to create an excavated interior cavity 244 and also cause the rebounding solid material impactors to flow into the major junk slot, or passage, 204A. The side nozzle 200A located on a side arm 214A of the drill bit 110 may also be oriented to allow the solid material impactors to contact the bottom surfqace 122 of the well bore 120 and then rebound into the major junk slot, or passage, 204A. The second side nozzle 200B is located on a second side arm 214B. The second side nozzle 200B may be oriented to allow the solid material impactors to contact the bottom surface 122 of the well bore 120 and then rebound into a minor junk slot, or passage, 204B. The orientation of the side nozzles 200A, 200B may be used to facilitate the drilling of the large exterior cavity 46. The side nozzles 200A, 200B may be oriented to cut different portions of the bottom surface 122. For example, the side nozzle 200B may be angled to cut the outer portion of the excavated exterior cavity 146 and the side nozzle 200A may be angled to cut the inner portion of the excavated exterior cavity 146. The major and minor junk slots, or passages, 204A, 204B allow the solid material impactors, cuttings, and drilling fluid 240 to flow up through the well bore annulus 124 back to the surface. The major and minor junk slots, or passages, 204A, 204B are oriented to allow the solid material impactors and cuttings to freely flow from the bottom surface 122 to the annulus 124.

As described earlier, the drill bit 110 may also comprise mechanical cutters and gauge cutters. Various mechanical cutters are shown along the surface of the drill bit 110. Hemispherical PDC cutters are interspersed along the bottom face and the side walls of the drill bit 110. These hemispherical cutters along the bottom face break down the large portions of the rock ring 142 and also abrade the bottom surface 122 of the well bore 120. Another type of mechanical cutter along the side arms 214A, 214B are gauge cutters 230. The gauge cutters 230 form the final diameter of the well bore 120. The gauge cutters 230 trim a small portion of the well bore 120 not removed by other means. Gauge bearing surfaces 206 are interspersed throughout the side walls of the drill bit 110. The gauge bearing surfaces 206 ride in the well bore 120 already trimmed by the gauge cutters 230. The gauge bearing surfaces 206 may also stabilize the drill bit 110 within the well bore 120 and aid in preventing vibration.

Still referring to FIG. 7 the center portion 203 comprises a breaker surface, located near the center nozzle 202, comprising mechanical cutters 208 for loading the rock ring 142. The mechanical cutters 208 abrade and deliver load to the lower stress rock ring 142. The mechanical cutters 208 may comprise PDC cutters, or any other suitable mechanical cutters. The breaker surface is a conical surface that creates the compressive and side loads for fracturing the rock ring 142. The breaker surface and the mechanical cutters 208 apply force against the inner boundary of the rock ring 142 and fracture the rock ring 142. Once fractured, the pieces of the rock ring 142 are circulated to the surface through the major and minor junk slots, or passages, 204A, 204B.

Figure 8:
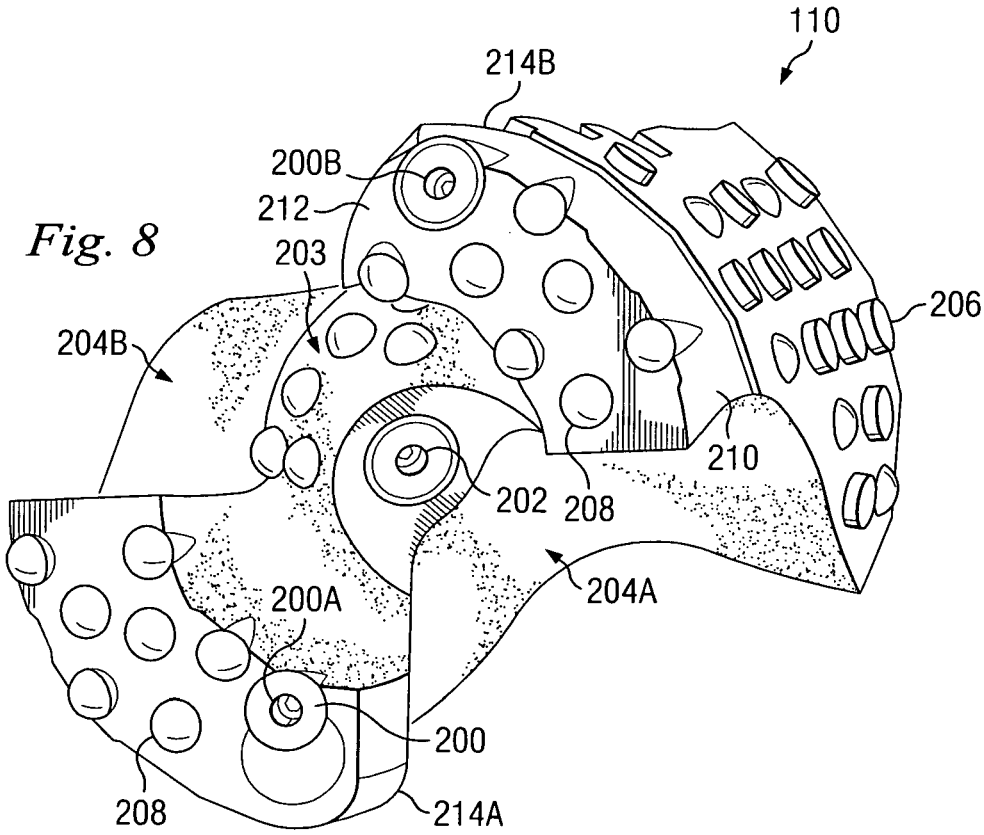
FIG. 8 is an enlarged end elevational view of the drill bit of FIG. 5.

Referring now to FIG. 8, an enlarged end elevational view of the drill bit 110 is shown. As shown more clearly in FIG. 8, the gauge bearing surfaces 206 and mechanical cutters 208 are interspersed on the outer side walls of the drill bit 110. The mechanical cutters 208 along the side walls may also aid in the process of creating drill bit 110 stability and also may perform the function of the gauge bearing surfaces 206 if they fail. The mechanical cutters 208 are oriented in various directions to reduce the wear of the gauge bearing surface 206 and also maintain the correct well bore 120 diameter. As noted with the mechanical cutters 208 of the breaker surface, the solid material impactors fracture the bottom surface 122 of the well bore 120 and, as such, the mechanical cutters 208 remove remaining ridges of rock and assist in the cutting of the bottom hole. However, the drill bit 110 need not necessarily comprise the mechanical cutters 208 on the side wall of the drill bit 110.

Figure 9:
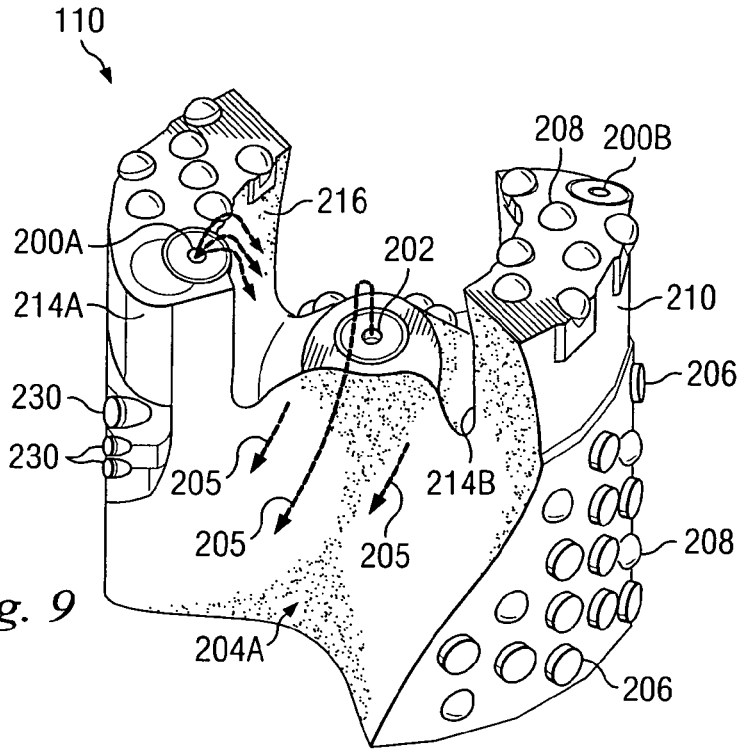
FIG. 9 is a perspective view of the drill bit of FIG. 5.

Referring now to FIG. 9, a side elevational view of the drill bit 110 is illustrated. FIG. 9 shows the gauge cutters 230 included along the side arms 214A, 214B of the drill bit 110. The gauge cutters 230 are oriented so that a cutting face of the gauge cutter 230 contacts the inner wall 126 of the well bore 120. The gauge cutters 230 may contact the inner wall 126 of the well bore at any suitable backrake, for example a backrake of 15° to 45°. Typically, the outer edge of the cutting face scrapes along the inner wall 126 to refine the diameter of the well bore 120.

Still referring to FIG. 9 one side nozzle 200A is disposed on an interior portion of the side arm 214A and the second side nozzle 200B is disposed on an exterior portion of the opposite side arm 214B. Although the side nozzles 200A, 200B are shown located on separate side arms 214A, 214B of the drill bit 110, the side nozzles 200A, 200B may also be disposed on the same side arm 214A or 214B. Also, there may only be one side nozzle, 200A or 200B. Also, there may only be one side arm, 214A or 214B.

Each side arm 214A, 214B fits in the excavated exterior cavity 146 formed by the side nozzles 200A, 200B and the mechanical cutters 208 on the face 212 of each side arm 214A, 214B. The solid material impactors from one side nozzle 200A rebound from the rock formation and combine with the drilling fluid and cuttings flow to the major junk slot 204A and up to the annulus 124. The flow of the solid material impactors, shown by arrows 205, from the center nozzle 202 also rebound from the rock formation up through the major junk slot 204A.

Figure 10:
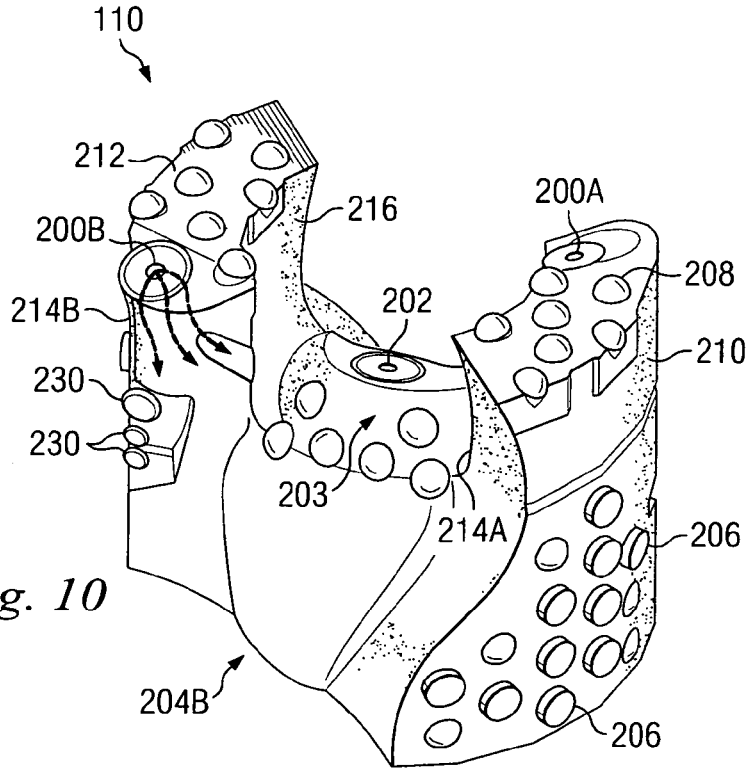
FIG. 10 is a perspective view of the drill bit of FIG. 5 illustrating a breaker and junk slot of a drill bit.
Figure 11:
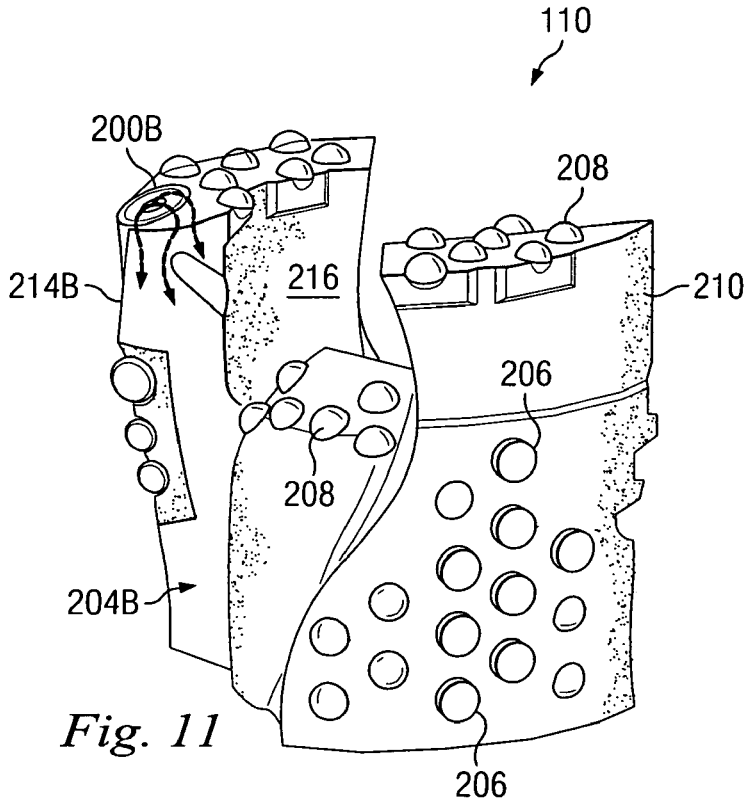
FIG. 11 is a side elevational view of the drill bit of FIG. 5 illustrating a flow of solid material impactors.

Referring now to FIGS. 10 and 11, the minor junk slot 204B, breaker surface, and the second side nozzle 200B are shown in greater detail. The breaker surface is conically shaped, tapering to the center nozzle 202. The second side nozzle 200B is oriented at an angle to allow the outer portion of the excavated exterior cavity 146 to be contacted with solid material impactors. The solid material impactors then rebound up through the minor junk slot 204B, shown by arrows 205, along with any cuttings and drilling fluid 240 associated therewith.

Figure 12:
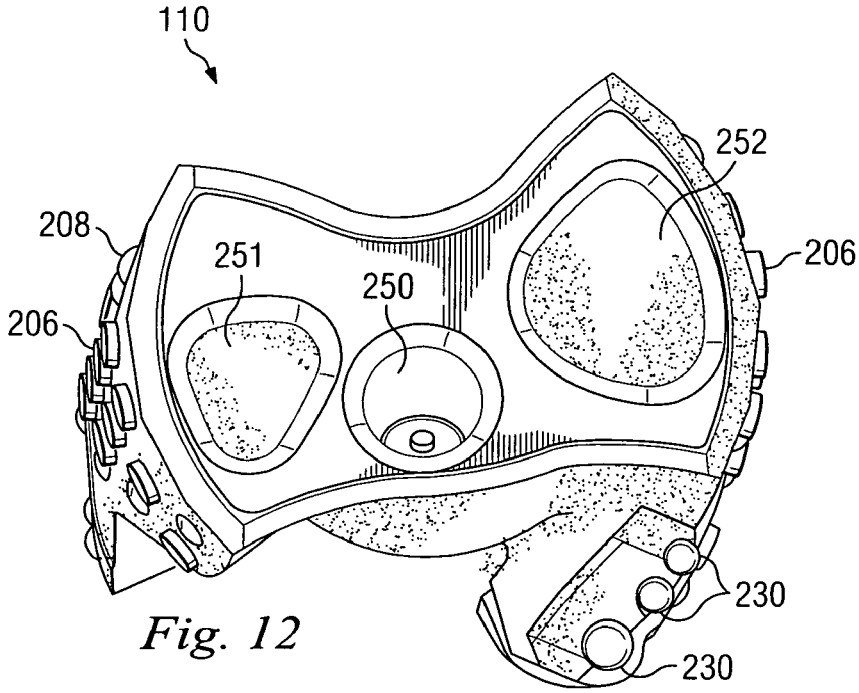
FIG. 12 is a top elevational view of the drill bit of FIG. 5 illustrating side and center cavities.
Figure 13:
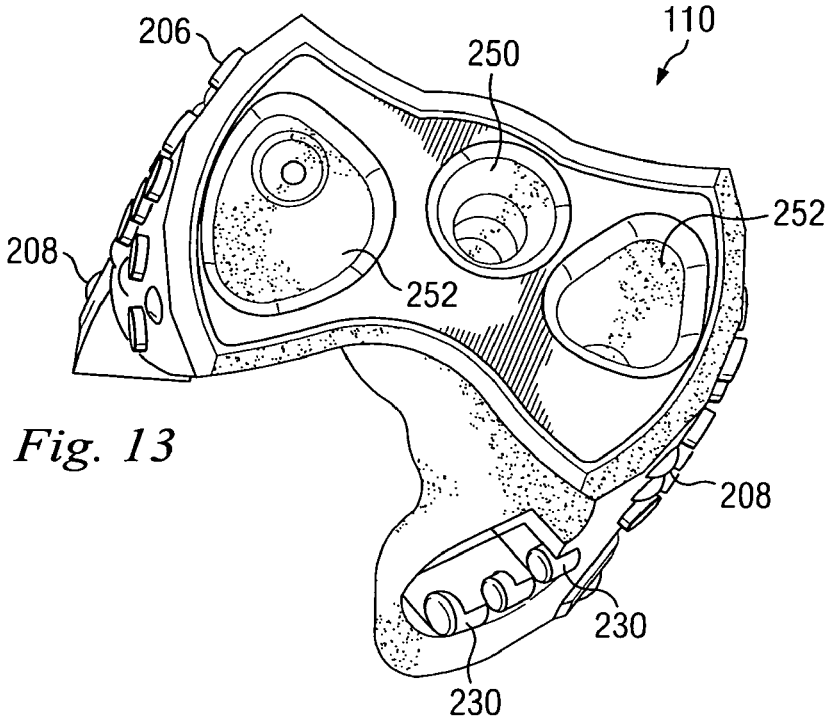
FIG. 13 is a canted top elevational view of the drill bit of FIG. 5.

Referring now to FIGS. 12 and 13, top elevational views of the drill bit 110 are shown. Each nozzle 200A, 200B, 202 receives drilling fluid 240 and solid material impactors from a common plenum feeding separate cavities 250, 251, and 252. Since the common plenum has a diameter, or cross section, greater than the diameter of each cavity 250, 251, and 252, the mixture, or suspension of drilling fluid and impactors is accelerated as it passes from the plenum to each cavity. The center cavity 250 feeds a suspension of drilling fluid 240 and solid material impactors to the center nozzle 202 for contact with the rock formation. The side cavities 251, 252 are formed in the interior of the side arms 214A, 214B of the drill bit 110, respectively. The side cavities 251, 252 provide drilling fluid 240 and solid material impactors to the side nozzles 200A, 200B for contact with the rock formation. By utilizing separate cavities 250, 251, 252 for each nozzle 202, 200A, 200B, the percentages of solid material impactors in the drilling fluid 240 and the hydraulic pressure delivered through the nozzles 200A, 200B, 202 can be specifically tailored for each nozzle 200A, 200B, 202. Solid material impactor distribution can also be adjusted by changing the nozzle diameters of the side and center nozzles 200A, 200B, and 202 by changing the diameters of the nozzles. However, in alternate embodiments, other arrangements of the cavities 250, 251, 252, or the utilization of a single cavity, are possible.

Figure 14:
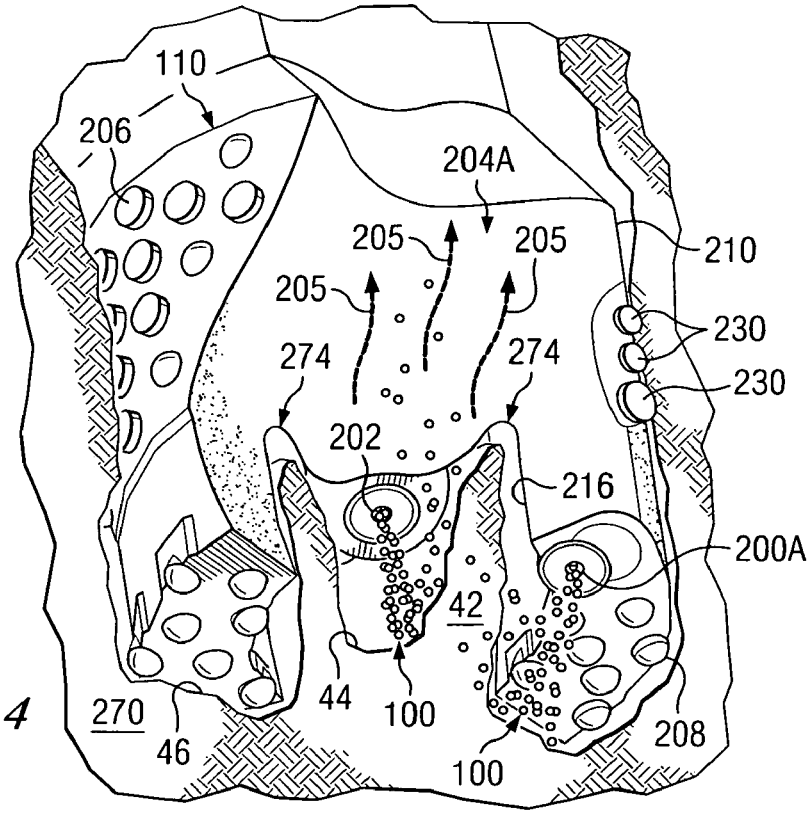
FIG. 14 is a cutaway view of the drill bit of FIG. 5 engaged in a well bore.

Referring now to FIG. 14, the drill bit 110 in engagement with the rock formation 270 is shown. As previously discussed, the solid material impactors 272 flow from the nozzles 200A, 200B, 202 and make contact with the rock formation 270 to create the rock ring 142 between the side arms 214A, 214B of the drill bit 110 and the center nozzle 202 of the drill bit 110. The solid material impactors 272 from the center nozzle 202 create the excavated interior cavity 244 while the side nozzles 200A, 200B create the excavated exterior cavity 146 to form the outer boundary of the rock ring 142. The gauge cutters 230 refine the more crude well bore 120 cut by the solid material impactors 272 into a well bore 120 with a more smooth inner wall 126 of the correct diameter.

Still referring to FIG. 14 the solid material impactors 272 flow from the first side nozzle 200A between the outer surface of the rock ring 142 and the interior wall 216 in order to move up through the major junk slot 204A to the surface. The second side nozzle 200B (not shown) emits solid material impactors 272 that rebound toward the outer surface of the rock ring 142 and to the minor junk slot 204B (not shown). The solid material impactors 272 from the side nozzles 200A, 200B may contact the outer surface of the rock ring 142 causing abrasion to further weaken the stability of the rock ring 142. Recesses 274 around the breaker surface of the drill bit 110 may provide a void to allow the broken portions of the rock ring 142 to flow from the bottom surface 122 of the well bore 120 to the major or minor junk slot 204A, 204B.

Figure 15:
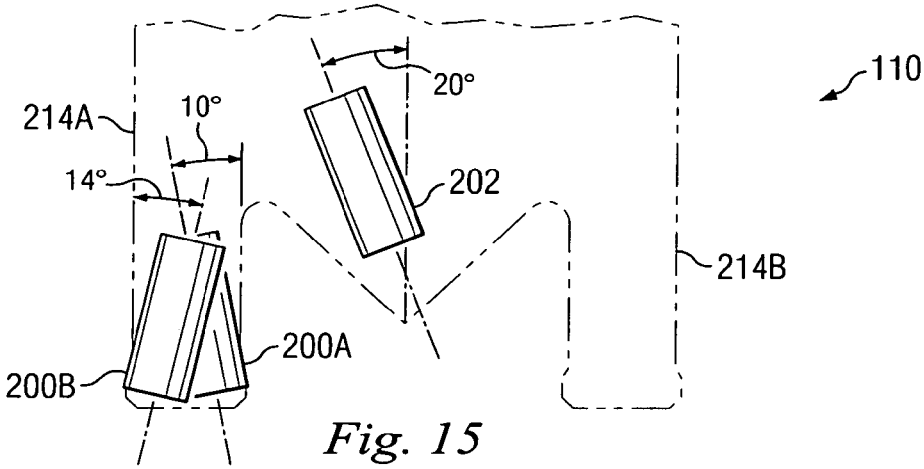
FIG. 15 is a schematic diagram of the orientation of the nozzles of a second embodiment of a drill bit.

Referring now to FIG. 15, an example orientation of the nozzles 200A, 200B, 202 are illustrated. The center nozzle 202 is disposed left of the center line of the drill bit 110 and angled on the order of around 200 left of vertical. Alternatively, both of the side nozzles 200A, 200B may be disposed on the same side arm 214 of the drill bit 110 as shown in FIG. 15. In this embodiment, the first side nozzle 200A, oriented to cut the inner portion of the excavated exterior cavity 146, is angled on the order of around 10° left of vertical. The second side nozzle 200B is oriented at an angle on the order of around 14° right of vertical. This particular orientation of the nozzles allows for a large interior excavated cavity 244 to be created by the center nozzle 202. The side nozzles 200A, 200B create a large enough excavated exterior cavity 146 in order to allow the side arms 214A, 214B to fit in the excavated exterior cavity 146 without incurring a substantial amount of resistance from uncut portions of the rock formation 270. By varying the orientation of the center nozzle 202, the excavated interior cavity 244 may be substantially larger or smaller than the excavated interior cavity 244 illustrated in FIG. 14. The side nozzles 200A, 200B may be varied in orientation in order to create a larger excavated exterior cavity 146, thereby decreasing the size of the rock ring 142 and increasing the amount of mechanical cutting required to drill through the bottom surface 122 of the well bore 120. Alternatively, the side nozzles 200A, 200B may be oriented to decrease the amount of the inner wall 126 contacted by the solid material impactors 272. By orienting the side nozzles 200A, 200B at, for example, a vertical orientation, only a center portion of the excavated exterior cavity 146 would be cut by the solid material impactors and the mechanical cutters would then be required to cut a large portion of the inner wall 126 of the well bore 120.

Figure 16:
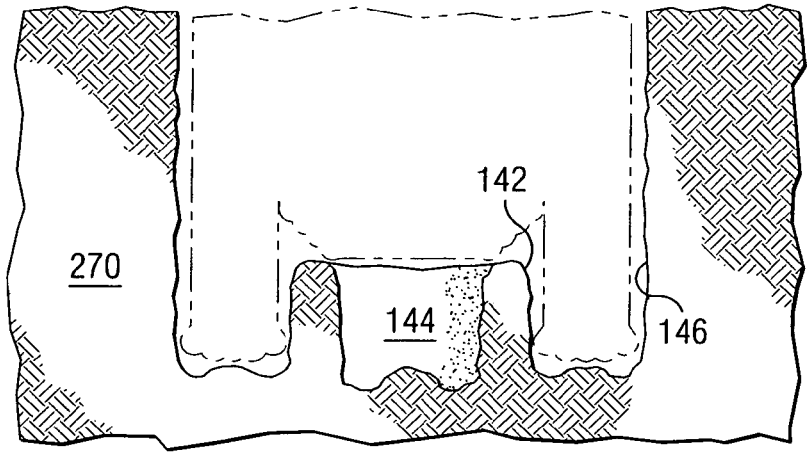
FIG. 16 is a side cross-sectional view of the rock formation created by the drill bit of FIG. 5 represented by the schematic of the drill bit of FIG. 5 inserted therein.
Figure 17:
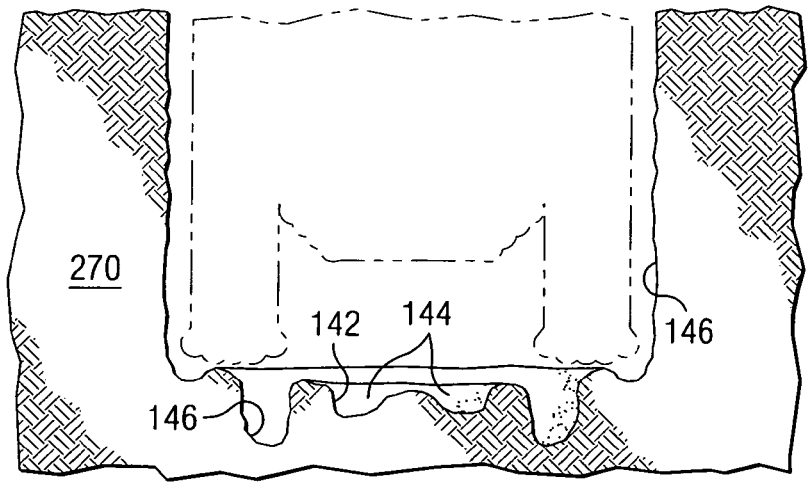
FIG. 17 is a side cross-sectional view of the rock formation created by drill bit of FIG. 5 represented by the schematic of the drill bit of FIG. 5 inserted therein.

Referring now to FIGS. 16 and 17, side cross-sectional views of the bottom surface 122 of the well bore 120 drilled by the drill bit 110 are shown. With the center nozzle angled on the order of around 20° left of vertical and the side nozzles 200A, 200B angled on the order of around 10° left of vertical and around 14° right of vertical, respectively, the rock ring 142 is formed. By increasing the angle of the side nozzle 200A, 200B orientation, an alternate rock ring 142 shape and bottom surface 122 is cut as shown in FIG. 17. The excavated interior cavity 244 and rock ring 142 are much more shallow as compared with the rock ring 142 in FIG. 16. It is understood that various different bottom hole patterns can be generated by different nozzle configurations.

Although the drill bit 110 is described comprising orientations of nozzles and mechanical cutters, any orientation of either nozzles, mechanical cutters, or both may be utilized. The drill bit 110 need not comprise a center portion 203. The drill bit 110 also need not even create the rock ring 142. For example, the drill bit may only comprise a single nozzle and a single junk slot. Furthermore, although the description of the drill bit 110 describes types and orientations of mechanical cutters, the mechanical cutters may be formed of a variety of substances, and formed in a variety of shapes.

Figure 18:
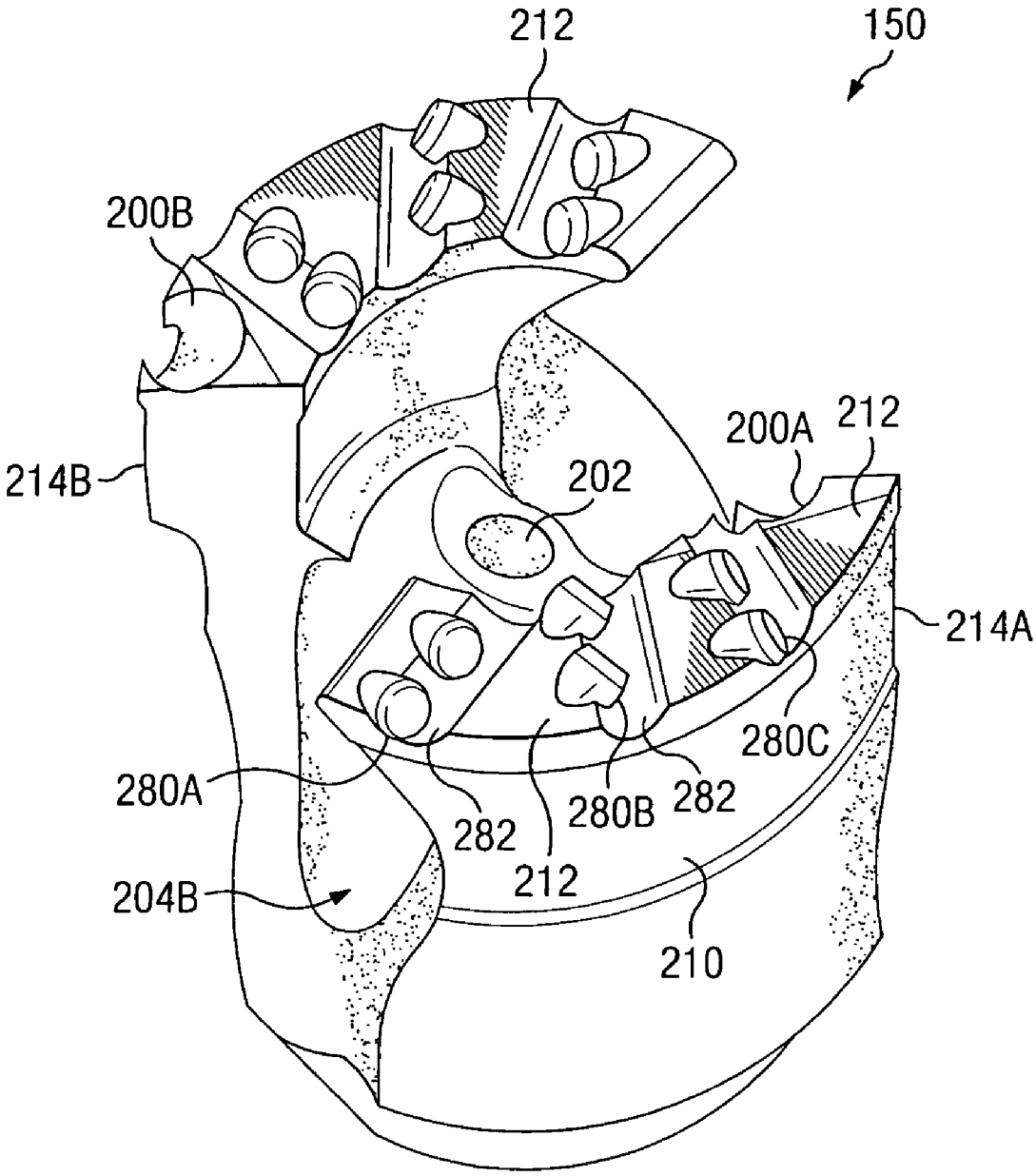
FIG. 18 is a perspective view of an alternate embodiment of a drill bit.
Figure 19:
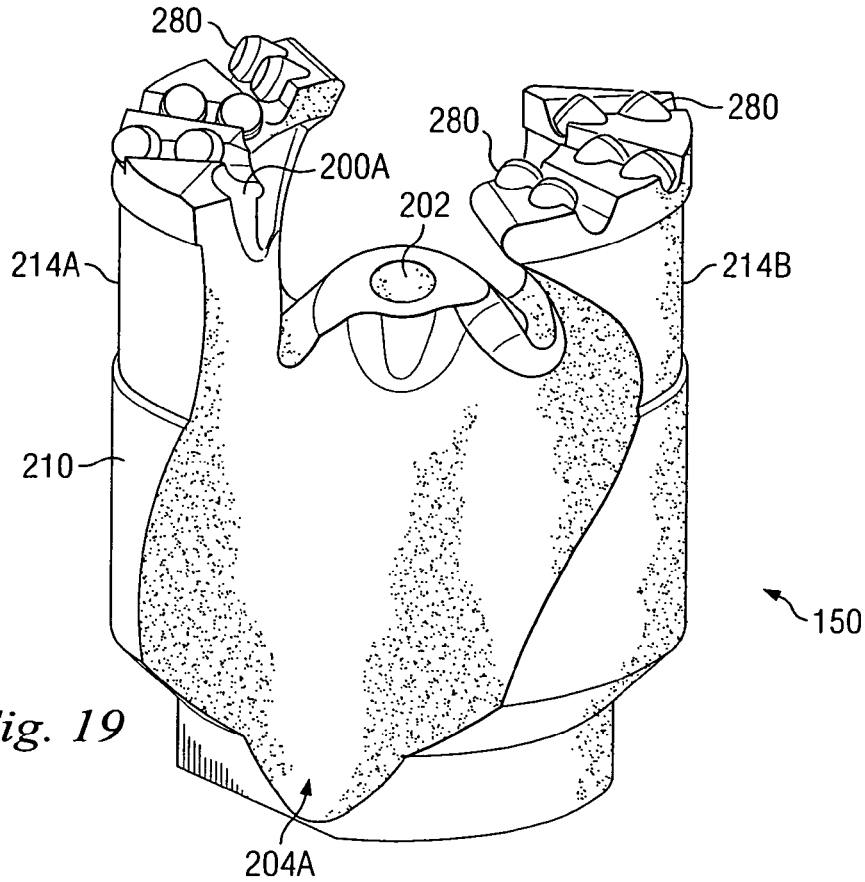
FIG. 19 is a perspective view of the drill bit of FIG. 18.

Referring now to FIGS. 18-19, a drill bit 150 in accordance with a second embodiment is illustrated. As previously noted, the mechanical cutters, such as the gauge cutters 230, mechanical cutters 208, and gauge bearing surfaces 206 may not be necessary in conjunction with the nozzles 200A, 200B, 202 in order to drill the required well bore 120. The side wall of the drill bit 150 may or may not be interspersed with mechanical cutters. The side nozzles 200A, 200B and the center nozzle 202 are oriented in the same manner as in the drill bit 150, however, the face 212 of the side arms 214A, 214B comprises angled (PDCs) 280 as the mechanical cutters.

Figure 20:
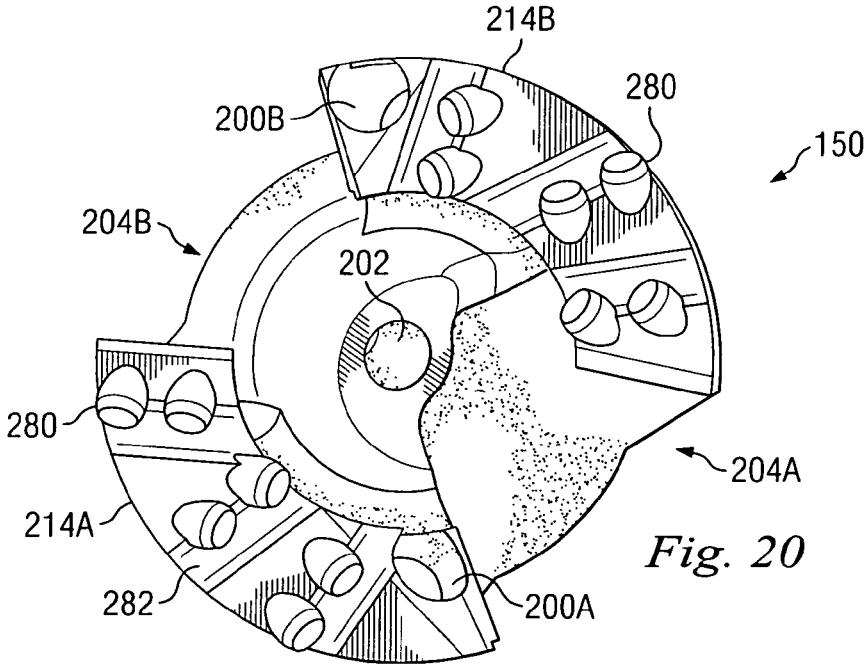
FIG. 20 illustrates an end elevational view of the drill bit of FIG. 18.

Still referring to FIGS. 18-20 each row of PDCs 280 is angled to cut a specific area of the bottom surface 122 of the well bore 120. A first row of PDCs 280A is oriented to cut the bottom surface 122 and also cut the inner wall 126 of the well bore 120 to the proper diameter. A groove 282 is disposed between the cutting faces of the PDCs 280 and the face 212 of the drill bit 150. The grooves 282 receive cuttings, drilling fluid 240, and solid material impactors and direct them toward the center nozzle 202 to flow through the major and minor junk slots, or passages, 204A, 204B toward the surface. The grooves 282 may also direct some cuttings, drilling fluid 240, and solid material impactors toward the inner wall 126 to be received by the annulus 124 and also flow to the surface. Each subsequent row of PDCs 280B, 280C may be oriented in the same or different position than the first row of PDCs 280A. For example, the subsequent rows of PDCs 280B, 280C may be oriented to cut the exterior face of the rock ring 142 as opposed to the inner wall 126 of the well bore 120. The grooves 282 on one side arm 214A may also be oriented to direct the cuttings and drilling fluid 240 toward the center nozzle 202 and to the annulus 124 via the major junk slot 204A. The second side arm 214B may have grooves 282 oriented to direct the cuttings and drilling fluid 240 to the inner wall 126 of the well bore 120 and to the annulus 124 via the minor junk slot 204B.

The PDCs 280 located on the face 212 of each side arm 214A, 214B are sufficient to cut the inner wall 126 to the correct size. However, mechanical cutters may be placed throughout the side wall of the drill bit 150 to further enhance the stabilization and cutting ability of the drill bit 150.

Figure 21:
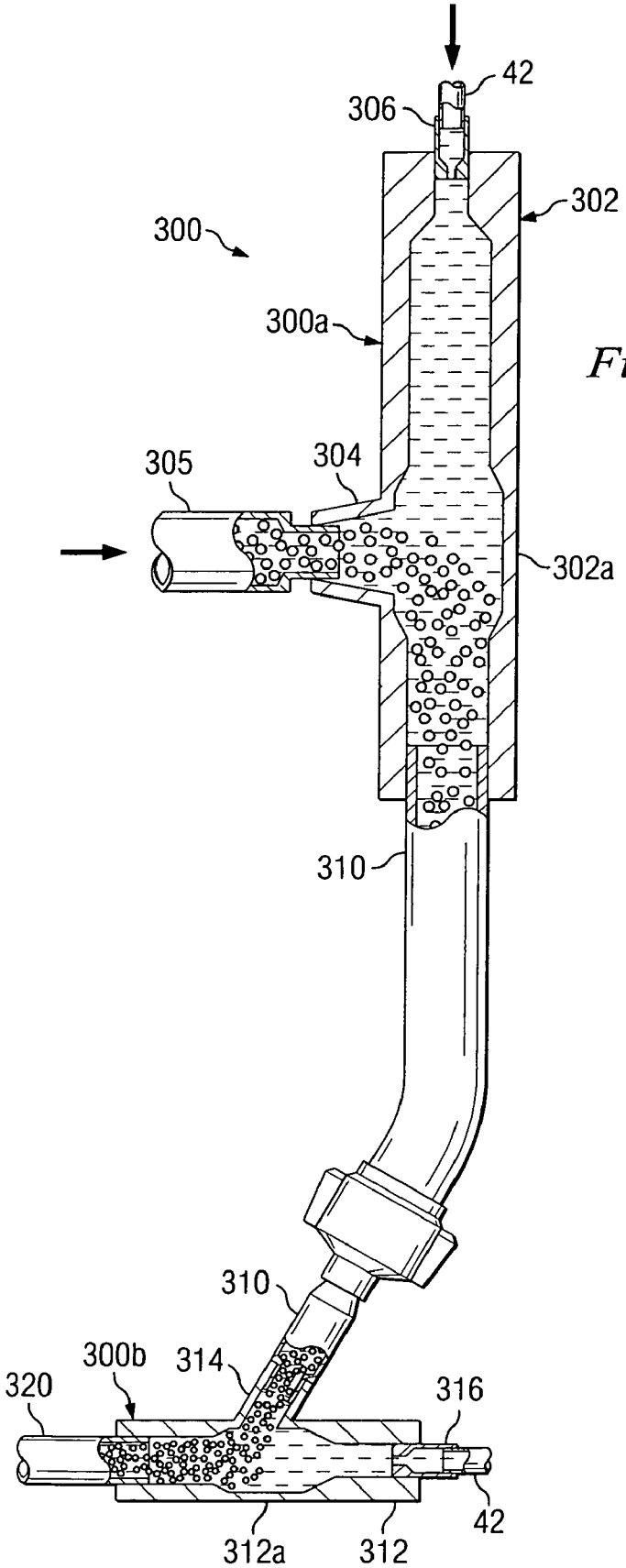
FIG. 21 is an elevational view of a two-stage eductor used in the system of FIG. 1.

Referring to FIG. 21, the reference numeral 300 refers, in general, to an alternate embodiment of a system for mixing the impactors 100 and the drilling fluid in the excavation system 1 of FIG. 1. The system 300 includes a first-stage eductor 300*a* and a second-stage eductor 300*b* that are in flow communication. The first-stage eductor 300*a* includes a cylindrical mixing vessel, or conduit 302 and a radially-extending inlet 304 registering with an opening in the vessel. The impactors 100 from the storage tank 94 (FIG. 1) are introduced into the inlet 304 by a conduit 305, which is connected to either the tank 98 or the screw elevator 14 (FIG. 1). It is understood that the impactors 100 will be premixed with a fluid, which can be the drilling fluid for the system, to form a slurry prior to being introduced into the conduit 305.

A nozzle 306 is mounted in one end portion of the vessel 302 with a portion of the nozzle extending into the vessel. The inlet of the nozzle 306 is connected to the hose 42 (also shown in FIG. 1), so that a portion of the drilling fluid 100 from the tank 6 (FIG. 1) is pumped by the pump 2 through the line 8 and the hose 42 before being introduced into the nozzle 206. The fluid is then discharged at a relatively high velocity and pressure from the nozzle 316 into the interior of the vessel 312. This creates a vacuum, or low pressure zone, by the well-known venturi-eductor effect, that draws the above slurry containing the impactors 100 from the conduit 305 into the vessel 302, via the inlet 304. The slurry mixes with the drilling fluid in the interior of the vessel 302 to form a suspension, which is discharged through a conduit 310 extending from an outlet formed in the other end of the vessel 302. It is understood that the distance, or axial length, that the nozzle 306 extends from the throat 302*a* of the vessel 302 can be determined empirically to insure that an optimum amount of the slurry from the conduit 305 is drawn into the vessel 302, based on the operating conditions.

The second-stage eductor 300*b* includes a mixing vessel, or conduit, 312 that is provided in proximity to the vessel 302 and has a throat 312*a* and an inlet 314 registering with an opening in the vessel. The suspension of the impactors 100 and the drilling fluid from the first-stage eductor 300*a* is passed, via the conduit 310, into the inlet 314.

A nozzle 316 is mounted in one end portion of the vessel 312 with a portion of the nozzle extending into the vessel. The inlet of the nozzle 316 is connected to the hose 42, or to a branch line extending from the hose, so that a portion of the drilling fluid 100 from the tank 6 (FIG. 1) is pumped by the pump 2 through the line 8 and the hose 42 before being introduced into the nozzle 316. The fluid is then discharged at a relatively high velocity and pressure from the nozzle 316 into the interior of the vessel 312. This draws the above suspension from the conduit 310 into the inlet 314 of the vessel 312, in the manner discussed above, and the suspension mixes with the drilling fluid from the nozzle 316 in the interior of the vessel 312 to form another suspension.

It is understood that the distance, or axial length, that the nozzle 316 extends from the throat 312*a* of the vessel 312 can be determined empirically to insure that an optimum amount of the suspension from the inlet 314 is drawn into the vessel 312.

A conduit 320 is connected to an outlet formed at the other end of the vessel 312 for passing the suspension to the drill bit 110 (FIG. 4) or to the drill bit 60 (FIG. 1.) for discharging in a manner to remove a portion of the formation at the bottom surface 122 (FIG. 5) of the well bore 120, as discussed above.

As a non-limiting example of the configuration and operation of the system 300, the discharge end of the nozzle 306 is axially spaced from the throat 302*a* a distance corresponding to approximately 14 nozzle diameters, while the discharge end of the nozzle 316 is axially spaced from the throat 312*a* a distance corresponding to approximately 3.5 nozzle diameters (in this context, FIG. 21 is not to scale).

The drilling fluid is discharged from the nozzle 306 into the vessel at approximately 40 gallons per minute (gpm) at a pressure of approximately 2000 pounds per square inch (psi). This creates a low pressure zone that draws the slurry including the impactors 100, which are at approximately atmospheric pressure, from the conduit 305 into the inlet 304 in the manner discussed above, at approximately 50 gpm (approximately 40 gpm of fluid and approximately 10 gpm of the impactors).

The impactors 100 mix with the drilling fluid in the interior of the vessel 302 to form a suspension that is at a positive pressure, such as approximately 200 psi, and is discharged through the outlet and to the conduit 310 at a volumetric flow rate of approximately 90 gpm. Thus, the ratio of the impactors 100 in the suspension is approximately 10:90 or approximately 11%.

The suspension of the impactors 100 and fluid flows through the conduit 310 and to the inlet 314 of the second-stage eductor 300*b* at the 200 psi pressure and 90 gpm flow rate. Another portion of the drilling fluid from the system 1 is introduced into the nozzle 316 in the manner discussed above in connection with the nozzle 306, and discharges from the nozzle 316 into the vessel 312 at a volumetric flow rate, of approximately 320 gpm and at a pressure of approximately 8500 psi. This drilling fluid creates a low pressure zone that draws the suspension of impactors 100 and the drilling fluid from the conduit 310 into the inlet 304 at the 90 gpm rate discussed above. The latter suspension mixes with the high pressure drilling fluid from the nozzle 316 in the interior of the vessel 312 to form another suspension that exits the vessel 312 and passes to the conduit 320 at a pressure of approximately 2000 psi and a discharge rate of approximately 410 gpm. This latter suspension passes to, and discharges from, the drill bit 60 in the manner discussed above to cut the formation at the bottom surface 122 (FIG. 5) of the well bore 120.

Thus, the nozzle 306 of the first-stage eductor 302*a* receives its drilling fluid from the system 1 and the horsepower from the system is utilized to pump the fluid to the nozzle. Also, the suspension of the impactors 100 and the drilling fluid that enters the inlet 314 of the second-stage eductor 300*b* is at a positive head, or pressure, (approximately 200 psi in the above example). As a result the suspension is discharged from the eductor 300*b* at a relatively high volumetric flow (410 gpm in the above example) without using any additional horsepower.

It is understood that variations can be may be made in the embodiments discussed above. For example, the axial distances that the nozzles 306 and 316 extend from the throats 302*a* and 312*a*, respectively can be varied in order to obtain optimum results. Also, the range of volumetric flow rates of the drilling fluid that is introduced into the nozzle 306 can be between 5 gpm and 100 gpm and the range of volumetric flow rates of the drilling fluid that is introduced into the nozzle 316 can be between 100 gpm and 700 gpm. Further, the percentage of impactors in the suspension discharging from the conduit 320 can vary from 5% to 30% by volume and the percentage of drilling fluid from 70% to 95% by volume.

Figure 22:
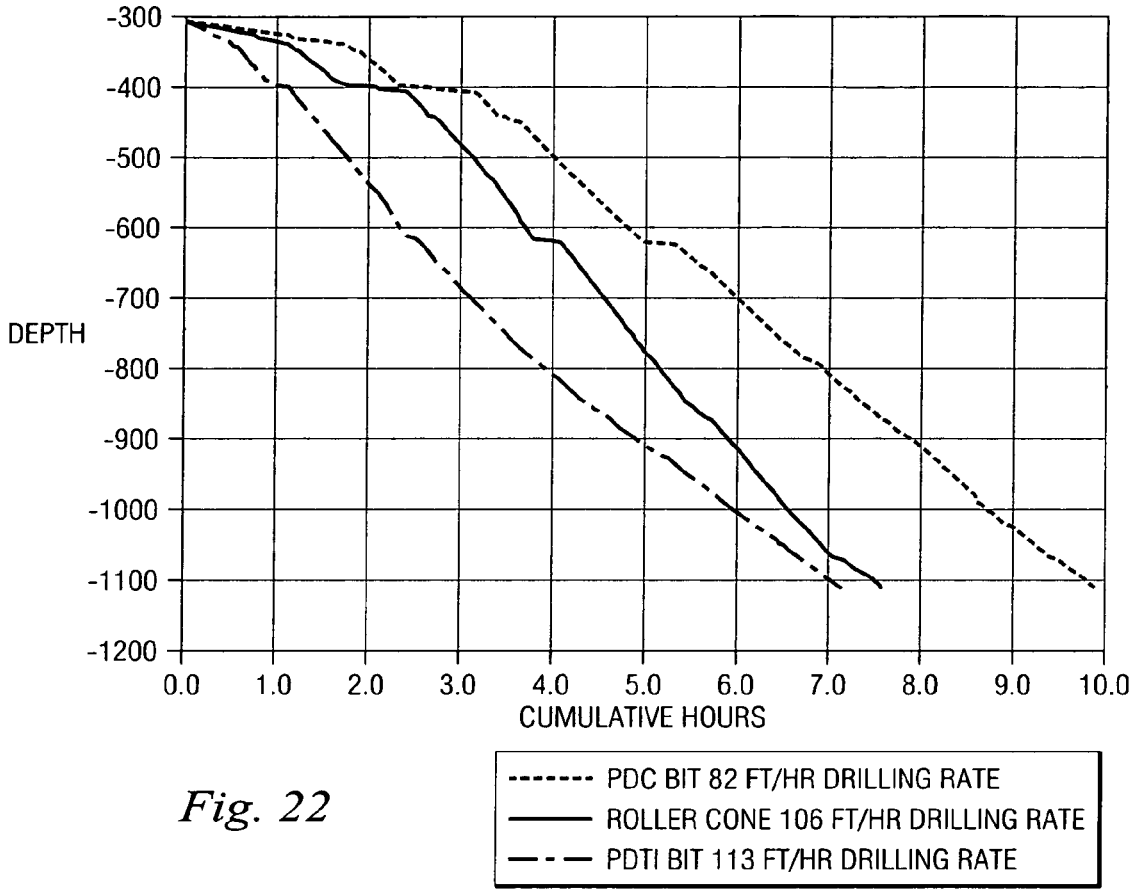
FIG. 22 is a graph depicting the performance of the excavation system according to one or more embodiments of the present invention as compared to two other systems.

FIG. 22 depicts a graph showing a comparison of the results of the impact excavation utilizing one or more of the above embodiments (labeled "PDTI in the drawing) as compared to excavations using two strictly mechanical drilling bits—a conventional PDC bit and a "Roller Cone" bit—while drilling through the same stratigraphic intervals. The drilling took place through a formation at the GTI (Gas Technology Institute of Chicago, Ill.) test site at Catoosa, Okla.

The PDC (Polycrystalline Diamond Compact) bit is a relatively fast conventional drilling bit in soft-to-medium formations but has a tendency to break or wear when encountering harder formations. The Roller Cone is a conventional bit involving two or more revolving cones having cutting elements embedded on each of the cones.

The graph of FIG. 22 details the performance of the three bits though 800 feet of the formation consisting of shales, sandstones, limestones, and other materials. For example, the upper portion of the curve (approximately 306 to 336 feet) depicts the drilling results in a hard limestone formation that has compressive strengths of up to 40,000 psi.

Note that the PDTI bit performance in this area was significantly better than that of the other two bits—the PDTI bit took only 0.42 hours to drill the 30 feet where the PDC bit took 1 hour and the roller cone took about 1.5 hours. The total time to drill the approximately 800 foot interval took a little over 7 hours with the PDTI bit, whereas the Roller cone bit took 7.5 hours and the PDC bit took almost 10 hours.

The graph demonstrates that the PDTI system has the ability to not only drill the very hard formations at higher rates, but can drill faster that the conventional bits through a wide variety of rock types.

The table below shows actual drilling data points that make up the PDTI bit drilling curve of FIG. 22. The data points shown are random points taken on various days and times. For example, the first series of data points represents about one minute of drilling data taken at 2:38 pm on Jul. 22$^{nd}$, 2005, while the bit was running at 111 RPM, with 5.9 thousand pounds of bit weight ("WOB"), and with a total drill string and bit torque of 1,972 Ft Lbs. The bit was drilling at a total depth of 323.83 feet and its penetration rate for that minute was 136.8 Feet per Hour. The impactors were delivered at approximately 14 GPM (gallons per minute) and the impactors had a mean diameter of approximately 0.100" and were suspended in approximately 450 GPM of drilling mud.

| DATE | TIME | RPM | TORQUE Ft. Lbs. | WOB Lbs. | DEPTH Ft. | PENETRATION FT/MIN | PENETRATION FT/HR |
|---|---|---|---|---|---|---|---|
| Jul. 25, 2005 | 2:38 PM | 111 | 1,972 | 5.9 | 323.83 | 2.28 | 136.8 |
| Jul. 25, 2005 | 4:24 PM | 103 | 2,218 | 9.1 | 352.43 | 2.85 | 171.0 |
| Jul. 25, 2005 | 9:36 AM | 101 | 2,385 | 9.5 | 406.54 | 3.71 | 222.6 |
| Jul. 25, 2005 | 10:17 AM | 99 | 2.658 | 10.9 | 441.88 | 3.37 | 202.2 |
| Jul. 25, 2005 | 11:29 AM | 96 | 2.646 | 10.1 | 478.23 | 2.94 | 176.4 |
| Jul. 25, 2005 | 4:41 PM | 97 | 2,768 | 12.2 | 524.44 | 2.31 | 138.6 |
| Jul. 25, 2005 | 4:54 PM | 96 | 2,870 | 10.6 | 556.82 | 3.48 | 208.8 |

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A system for excavating a subterranean formation, the system comprising:

a source of impactors;

a source of drilling fluid;

a first vessel connected to the source of impactors;

a first nozzle connected to the source of drilling fluid for discharging fluid into the first vessel to draw the impactors into the first vessel to form a suspension that is discharged from the first vessel;

a second vessel connected to the first eductor for receiving the discharged suspension from a first eductor;

a second nozzle connected to the source of drilling fluid for discharging fluid into the second vessel to draw the suspension into the second vessel to create another suspension that is discharged from the second vessel; and a body member for receiving the second suspension and discharging same to remove at least a portion of the formation.

2. The system of claim 1 wherein the impactors are drawn into the first vessel at a first pressure, and wherein the suspension is discharged from the first vessel at a second pressure that is greater than the first pressure.

3. The system of claim 2 wherein the first pressure is approximately atmospheric pressure.

4. The system of claim 1 wherein the body member has at least one cavity formed therein for receiving the second suspension and discharging same.

5. The system of claim 4 further comprising a nozzle disposed in the cavity for discharging the second suspension at a relatively high velocity from the cavity and towards the formation to cut the formation.

6. The system of claim 4 further comprising means associated with the body member for mechanically drilling the formation to remove another portion of the formation.

7. A system excavating a subterranean formation, the system comprising:

a source of impactors;

a source of drilling fluid;

first means connected to the source of the impactors for receiving the impactors at a first pressure, the first means being connected to the source of the fluid for forming a first suspension of the impactors and the fluid at a second pressure that is greater than the first pressure;

second means connected to the first means and to the fluid source for receiving the first suspension at the second pressure and for forming a second suspension of the impactors and the fluid at a third pressure that is greater than the second pressure; and a body member for receiving the second suspension discharging same to remove at least a portion of the formation.

8. The system of claim 7 wherein the impactors are received by the first means at a first pressure and wherein the suspension is received by the second means at a second pressure that is greater than the first pressure.

9. The system of claim 8 wherein the first pressure is approximately atmospheric pressure.

10. The system of claim 7 wherein the body member has at least one cavity formed therein for receiving the second suspension and discharging same.

11. The system of claim 10 further comprising a nozzle disposed in the cavity for discharging the second suspension at a relatively high velocity from the cavity and towards the formation to cut the formation.

12. The system of claim 7 further comprising means associated with the body member for mechanically drilling the formation to remove another portion of the formation.

* * * * *